US009437978B2

(12) United States Patent
Green

(10) Patent No.: US 9,437,978 B2
(45) Date of Patent: Sep. 6, 2016

(54) MODULAR ELECTRICAL CONNECTOR

(71) Applicant: Wesley G. Green, Larkspur, CO (US)

(72) Inventor: Wesley G. Green, Larkspur, CO (US)

( * ) Notice: Subject to any disclaimer, the term of this patent is extended or adjusted under 35 U.S.C. 154(b) by 0 days.

(21) Appl. No.: 14/731,845

(22) Filed: Jun. 5, 2015

(65) Prior Publication Data

US 2015/0357762 A1 Dec. 10, 2015

Related U.S. Application Data

(60) Provisional application No. 62/010,035, filed on Jun. 10, 2014.

(51) Int. Cl.

| | |
|---|---|
| ***H01R 24/78*** | (2011.01) |
| ***H01R 13/652*** | (2006.01) |
| ***H01R 13/717*** | (2006.01) |
| ***H01R 13/74*** | (2006.01) |
| ***H01R 25/00*** | (2006.01) |
| *H01R 103/00* | (2006.01) |
| *H01R 13/66* | (2006.01) |

(52) U.S. Cl.

CPC ..... *H01R 13/652* (2013.01); *H01R 13/7175* (2013.01); *H01R 13/743* (2013.01); *H01R 24/78* (2013.01); *H01R 25/006* (2013.01); *H01R 13/6691* (2013.01); *H01R 2103/00* (2013.01)

(58) Field of Classification Search

CPC . H01R 25/006; H01R 13/6395; H01R 13/73
See application file for complete search history.

(56) References Cited

U.S. PATENT DOCUMENTS

| | | | | |
|---|---|---|---|---|
| 1,933,358 | A | 10/1933 | Almcrantz | |
| 1,938,309 | A | 12/1933 | Williams | |
| 2,410,287 | A | 10/1946 | Jaberg | |
| 2,433,917 | A | 1/1948 | McCartney | |
| 2,828,394 | A | 3/1958 | Mayzik | |
| 2,920,303 | A | 1/1960 | Johnson | |
| 3,609,647 | A | 9/1971 | Castellano | |
| 3,879,101 | A | 4/1975 | McKissic | |
| 4,165,443 | A | 8/1979 | Figart et al. | |
| 4,842,551 | A | 6/1989 | Heimann | |
| 5,203,712 | A | 4/1993 | Kilpatrick et al. | |
| 5,574,256 | A * | 11/1996 | Cottone | H01R 13/6395 174/53 |
| 6,379,166 | B1 * | 4/2002 | Hagarty | G02B 6/4466 439/134 |
| 6,514,652 | B2 * | 2/2003 | Cash, Jr. | H02G 3/00 439/106 |
| 6,527,598 | B1 * | 3/2003 | Opel | H02G 3/00 439/709 |
| 6,617,511 | B2 | 9/2003 | Schultz et al. | |
| 7,034,222 | B1 | 4/2006 | York | |
| 7,160,147 | B1 * | 1/2007 | Stephan | H01R 9/24 174/60 |
| 7,425,677 | B2 | 9/2008 | Gates et al. | |

(Continued)

OTHER PUBLICATIONS

"Build-To-Spec Wiring Devices," Cooper Wiring Devices, Cooper Industries, Ltd., 2009, pp. 1-6.

(Continued)

*Primary Examiner* — Truc Nguyen
(74) *Attorney, Agent, or Firm* — Sheridan Ross, P.C.

(57) ABSTRACT

A system for providing electrical energy and related components is provided. More specifically, a universal module that is adapted to fit within a junction box commonly found in building construction is provided. The wire cable associated with a dwelling, for example, is interconnected to the module, which provides a plurality of locations for receipt of corresponding electrical connectors of an outlet or switch. The modules quickly and safely receive an electrical component, which reduces time and associated costs related to electrical system installation, repair, or modification.

30 Claims, 16 Drawing Sheets

(56) References Cited

U.S. PATENT DOCUMENTS

| | | | | |
|---|---|---|---|---|
| 7,569,771 | B2 * | 8/2009 | Nicholson | H02G 3/18 174/481 |
| 8,028,408 | B2 | 10/2011 | Gorman | |
| 8,415,561 | B2 * | 4/2013 | Gates | H01R 13/508 174/481 |
| 8,752,972 | B2 * | 6/2014 | Bonarirgo | H02J 9/02 362/95 |
| 2002/0072272 | A1 | 6/2002 | King | |
| 2005/0272304 | A1 | 12/2005 | Gorman | |
| 2006/0025012 | A1 | 2/2006 | Fields | |
| 2006/0105626 | A1 * | 5/2006 | Scott | H01R 9/2491 439/535 |
| 2006/0145632 | A1 | 7/2006 | Fiene | |

OTHER PUBLICATIONS

International Search Report for International (PCT) Patent Application No. PCT/US15/34415, mailed Sep. 15, 2015, 3 pages.

Written Opinion for International (PCT) Patent Application No. PCT/US15/34415, mailed Sep. 15, 2015, 7 pages.

* cited by examiner

MODULAR ELECTRICAL CONNECTOR

This application claims the benefit of U.S. Provisional Patent Application Ser. No. 62/010,035, filed Jun. 10, 2014, the entire disclosure of which is incorporated by reference herein

FIELD OF THE INVENTION

Embodiments of the present invention are generally related to electric circuit components and, more particularly, to modules that interconnect electrical components such as outlets, switches, receptacles, and other devices for selectively providing or controlling electricity to a power source.

BACKGROUND OF THE INVENTION

Electrical system installation is a one time consuming and expensive task performed during building construction and renovation. The process starts with attaching junction boxes on exposed wall studs at pre-determined locations throughout the building. The junction boxes will eventually house electrical components such as outlets and switches. Next, the electrician routes wire cable from a circuit breaker box to the junction boxes and, if required, wires individual junction boxes together. As one of ordinary skill in the art will appreciate, the wire cable is often comprised of a hot wire, a neutral wire, and a ground wire. After the wire cables are associated with their respective junction boxes, drywall is attached to the exposed studs, wherein openings are formed in the drywall to allow access to the junction boxes. Next, electrical components are placed in the junction boxes and interconnected to the wires of the wire cable. Finally, cover plates are manually installed over the electrical components.

Several inherent problems are associated with the conventional electrical system installation method. First, this method of electrical system insulation is time-consuming and often expensive because of the number of connections that must be made and made correctly. Even if the electrical component is installed correctly, the interconnected wires may separate from the electrical component when placed in the junction box. That is, the space between the rear or side surfaces of the electrical component, i.e., the location of wire interconnection, and the walls of the junction box is minimal. The wires must fit within the space, which is often very difficult, and wires often become loose or detached from the electrical component when installed within the junction box.

The standard method of electrical system installation can result in unfit and unsafe connections. More specifically, wires are often interconnected to the electrical component using conductive screws on the electrical component. Connecting wires with wire screws may leave conductive wire material exposed. This condition may go unnoticed during initial electrical system testing, but may become more pronounced over time. As wires inside junction boxes are in close proximity to each other, a short-circuit or fire may result.

In addition, junction boxes typically contain a plurality of wires, the number of which increases with circuit complexity, as in 3-way or 4-way switched circuits. As a number of wires increases, the possibility that the electrician might incorrectly interconnect wires increases. Unfortunately, if the components are incorrectly wired, the electrician must spend costly time re-wiring. Further, complex circuitry may not fit inside a conventional junction box because the numbers of wires and wire screws involved.

Electrical installation is also prone to other errors. For example, if the junction box is not properly positioned on the wall stud (i.e., positioned too far forward or back), the front of the electrical component may not be flush with the drywall. This error is very difficult to correct because at the point when the electrical component is installed, the drywall has already been installed. To access the junction box for re-positioning on the stud, a section of drywall may have to be removed and repaired.

Homeowners or remodelers also experience problems with repair or replacement of standard electrical wiring. Replacing broken outlets or switches first requires removal of the electrical component, which requires removal of wires interconnected thereto. This process is then reversed to attach the wires to a new electrical component that will be attached to the junction box. This procedure exposes the homeowner to AC wiring and, thus, a shock hazard. Further, a homeowner's reluctance to change broken devices or to spend the money to hire an electrician also creates a shock and fire hazard from continued use of cracked, broken, or excessively worn outlets or switches. In addition, the integrity of original wiring becomes questionable if a homeowner or third-party replaces an electrical device. A mis-wiring, such as inadvertently switching the hot and neutral conductors, failing to attach ground wires, kinking or nicking conductors, or improperly tightening connections, can violate building codes and create shock and fire hazards.

Thus it is a long felt need to provide an electrical system that facilitates installation and interconnection of electrical devices, such as outlets and switches to a power supply. The contemplated system of one embodiment of the present invention employs modules interconnected to the power supply. The modules received the electrical components in a safe and effective manner.

SUMMARY OF THE INVENTION

It is one aspect of some embodiments of the present invention to provide a system for delivering electricity to an outlet. More specifically, one embodiment of the present invention employs a module interconnected to an electrical wire cable. The wire cable generally includes a hot wire, a neutral wire, and a ground wire. The module also includes mechanisms, such as lugs or wire screws, that receive and secure the hot wire, the neutral wire, and the ground wire. The module is received within a junction box. The junction box may be interconnected to a structural member of the building. In some embodiments, the module includes a clip, or other mechanism, for selective interconnection to a customized junction box. In other embodiments, the module is connected to the junction box by way of a screw or other fastener. As will be appreciated, embodiments of the present invention improve the ease and speed of electrical component installation. The modules and associated hardware described herein can be used during building construction and electrical component replacement.

The module facilitates outlet installation by providing a plurality of receptacles that receive prongs associated with the outlet. Although the term "outlet" is used primarily herein, those of ordinary skill in the art will appreciate that a switch, light, or other electrical device, for example, may be associated with the module described herein without departing from the scope of the invention. The receptacles of one embodiment of the present invention are generally cylindrical and receive corresponding cylindrically shaped prongs associated with the electrical component. Still other embodiments of the present invention employ slots that receive prongs of a shape found on, or similar to, those of common electrical plugs. The prongs and their respective receptacles may be of different sizes or configurations. For example, a prong associated with the hot wire may be of a greater diameter than that of the neutral wire. Or, the hot wire prong may be flat and the neutral wire prong may be cylindrical. This functionality helps prevent incorrect interconnection of the electrical component to the module. In some embodiments of the present invention, the module employs prongs received within outlet receptacles. In yet other versions, prongs and receptacles are not used and electricity-conducting plates are used to connect the module to the electrical component.

The outlet of one embodiment of the present invention includes a traditional outlet face adapted to receive a 2 or 3 prong plug. Those of ordinary skill in the art will appreciate the outlet may be associated with a light switch, a dimmer switch, a fan control, a USB port, or a low-voltage control (e.g., speaker control, thermostat control, alarm control, etc.). The rear side of the electrical component includes a plurality of prongs, or other electrical connection means that interface with corresponding electrical connectors on the module. As mentioned above, in one embodiment of the present invention, the electrical connectors of the outlet are prongs that selectively interface with corresponding receptacles of the module.

It is another aspect of embodiments of the present invention to provide a module installed internally relative to the junction box, wherein associated electrical components are selectively installed into the module without exposure to or access to the electrical system wiring attached to the module. The majority of the electricians work can thus be completed at the rough construction phase when wire cable installation is complete. Thus there may be no need for the electrician to return to the job site during final construction phase, because any semi-skilled labor can interconnect an appropriate outlet or switch to the module. It follows that there is no wire access after the rough phase, which protects circuit integrity. Finally, the use of a module means no exposed conductors or parts inside the junction box that can be inadvertently damaged during electrical component installation.

The contemplated system also benefits the general contractor. Because wiring is completed during rough construction phase, verification and activation can be performed earlier. If an electrical system issue arises, it can be corrected before drywall is installed and walls painted, eliminating cut and patch repairs. This aspect is further realized by modules that employ an indicator, e.g., a light or sound emitting device, or a wireless signal, that tells the contractor that the wire cable has been correctly interconnected to the module. That is, to help ensure that the module has been connected correctly, some modules of the present invention employ a light or other indicator. For example, an LED light may be used to notify the electrician or homeowner that all wires have been correctly interconnected to the module. The LED light may turn off after a predetermined amount of time. Early electrical system activation eliminates the need to use generators. Lack of access to the electrician's wiring preserves the integrity after verification and eliminates shock exposure to other workers.

It is yet another aspect of embodiments of the present invention to provide an electrical system that benefits a homeowner, as broken outlets and switches can be easily and safely repaired. Safety is enhanced by reducing exposure to wiring and encouraging replacement of defective outlets and switches. Further, costs are reduced by reducing the need to hire an electrician for repairs. Wiring integrity is insured by reducing the opportunity of unqualified homeowners and third parties to access the electrical system. Cost and annoyances are reduced by forgoing the permitting process as well.

The contemplated module is scalable. More specifically, the module provides an interface between a power supply and an outlet or switch. Therefore, the module may be increased in size to accommodate its end use. The module may be sized to receive an outlet and a switch, or multiple outlets and switches. Thus, some modules may include, or be interconnected to, connectors that allow for multiple modules to be interconnected in series. This aspect is desirable as an electrician will only need to stock modules of one size, wherein modules can be added together as needed to accommodate the type and size of desired electrical component.

Embodiments of the present invention facilitate interconnection of the outlet to the module by including indicia that shows the installer where each wire of the wire cable is to be connected. For example, the indicia may include a color code that corresponds with insulation colors commonly found on the wires of the wire cables—black, white, red, green (or bare, i.e., copper). The wire connection indicia will reduce errors and, thus, accuracy of electrical system installation and replacement will be increased dramatically for the experienced electrician and the do-it-yourselfer. In the operation of one embodiment, wires are inserted into terminals on the module marked by numbers 1, 2, and 3. Each wire then secured by tightening is a set screw associated with the terminal. Again, the wire terminal may be the wire lug, stab connector, pig tail wires, wire nuts, butt connectors, weld tab, adhesive tab, or any other wire connection method known in the art. Further, the wires can be interconnected on a side lateral surface of the module. The modules may include a front face with indicia that corresponds with the nature of outlet prongs—hot, neutral, or ground. This feature helps prevent the outlet from being interconnected upside-down.

It is yet another aspect of some embodiments of the present invention to facilitate junction box installation by providing an easy to install mounting plate. The contemplated mounting plate supports a junction box and includes a portion that interconnects to an interior wall member, such as drywall. In some embodiments of the present invention, this portion includes a finger that engages the outer surface of the drywall (i.e., the surface that will be textured and painted.) The finger spaces a portion of the mounting plate that will support the junction box from the outer surface. That is, the finger helps position the mounting plate on the stud at the ideal location. Thereafter, the mounting plate is fastened to the stud with a plurality of screws. The junction box is then interconnected to the mounting plate, which locates the junction box in an ideal location relative to the outer surface of the drywall or outer wall finish surface. In one embodiment, the mounting plate is received within a channel provided in the outside of the junction box. The junction box of one embodiment is not secured to the mounting plate and is, thus, able to slide relative to the wall stud.

The modules or electrical components of some embodiments include wireless communication devices, e.g., Wi-Fi or Bluetooth® communication devices. The communication devices can be used to notify a similarly enabled device, e.g., a smart phone or tablet, that the connection of a particular module or group of modules is correct. In addition, a mobile device could be used to selectively control power flow coming from a module or control a switch interconnected to the module. For example, lamps and light switches may be remotely controlled via the module/outlet. This functionality may allow individuals to program light/outlet function with their smart phone. Also, a smart phone, or other communication device, may be used to selectively turn on and turn off lights when an individual enters and exits a room, which will save power. Such functionality can also be used to help pinpoint an individual's location in a home or other building so long as the individual possesses a communication device, which would be desirable to policemen, firemen, and EMTs.

The present invention is made of materials commonly used in the electrical arts. Further, the module and outlet may be shaped as shown in the figures provided herein, or made of any desired shape, so long as the wires, connectors, receptacles, and prongs contemplated and described herein can be accommodated.

Further aspects of the present invention are provided in the following embodiments:

It is yet another aspect of embodiments of the present invention to provide a modular electrical connector, comprising a junction box having an aperture adapted to receive a wire cable comprised of a hot wire, a neutral wire, and a ground wire, the junction box having a cavity on a lateral surface thereof; a mounting plate adapted for interconnected to a building member, the mounting plate having an anchor that is selectively received by the cavity in the junction box to interconnect the junction box to the building member; a module having: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; an indicator that illuminates when at least one of the hot wire, the neutral wire, and ground wire are properly interconnected to the module; and an electrical component having a first prong for interconnection to the first receptacle of the module, a second prong for interconnection to the second receptacle, and a third prong for interconnection to the third receptacle.

It is yet another aspect of embodiments of the present invention to provide a modular electrical connector, comprising a junction box having an aperture adapted to receive a wire cable comprised of a hot wire, a neutral wire, and a ground wire, the junction box having a cavity on a lateral surface thereof; a mounting plate adapted for interconnected to a building member, the mounting plate having an anchor that is selectively received by the cavity in the junction box to interconnect the junction box to the building member; a module having: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; an indicator that illuminates when at least one of the hot wire, the neutral wire, and ground wire are properly interconnected to the module; and an electrical component having a first prong for interconnection to the first receptacle of the module, a second prong for interconnection to the second receptacle, and a third prong for interconnection to the third receptacle, wherein the first connector, the second connector, and the third connector are wire screws.

It is yet another aspect of embodiments of the present invention to provide a modular electrical connector, comprising a junction box having an aperture adapted to receive a wire cable comprised of a hot wire, a neutral wire, and a ground wire, the junction box having a cavity on a lateral surface thereof; a mounting plate adapted for interconnected to a building member, the mounting plate having an anchor that is selectively received by the cavity in the junction box to interconnect the junction box to the building member; a module having: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; an indicator that illuminates when at least one of the hot wire, the neutral wire, and ground wire are properly interconnected to the module; and an electrical component having a first prong for interconnection to the first receptacle of the module, a second prong for interconnection to the second receptacle, and a third prong for interconnection to the third receptacle, wherein the first connector, the second connector, and the third connector are wire lugs.

It is yet another aspect of embodiments of the present invention to provide a modular electrical connector, comprising a junction box having an aperture adapted to receive a wire cable comprised of a hot wire, a neutral wire, and a ground wire, the junction box having a cavity on a lateral surface thereof; a mounting plate adapted for interconnected to a building member, the mounting plate having an anchor that is selectively received by the cavity in the junction box to interconnect the junction box to the building member; a module having: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; an indicator that illuminates when at least one of the hot wire, the neutral wire, and ground wire are properly interconnected to the module; and an electrical component having a first prong for interconnection to the first receptacle of the module, a second prong for interconnection to the second receptacle, and a third prong for interconnection to the third receptacle, wherein the indicator is a LED light.

It is yet another aspect of embodiments of the present invention to provide a modular electrical connector, comprising a junction box having an aperture adapted to receive a wire cable comprised of a hot wire, a neutral wire, and a ground wire, the junction box having a cavity on a lateral surface thereof; a mounting plate adapted for interconnected to a building member, the mounting plate having an anchor that is selectively received by the cavity in the junction box to interconnect the junction box to the building member; a module having: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; an indicator that illuminates when at least one of the hot wire, the neutral wire, and ground wire are properly interconnected to the module; and an electrical component having a first prong for interconnection to the first receptacle of the module, a second prong for interconnection to the second receptacle, and a third prong for interconnection to the third receptacle, wherein the first prong, the second prong, and the third prong are positioned in a plane that is parallel to a plane that corresponds with a plane that is equidistant from a left lateral surface and a right lateral surface of the outlet.

It is yet another aspect of embodiments of the present invention to provide a modular electrical connector, comprising a junction box having an aperture adapted to receive a wire cable comprised of a hot wire, a neutral wire, and a ground wire, the junction box having a cavity on a lateral surface thereof; a mounting plate adapted for interconnected to a building member, the mounting plate having an anchor that is selectively received by the cavity in the junction box to interconnect the junction box to the building member; a module having: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; an indicator that illuminates when at least one of the hot wire, the neutral wire, and ground wire are properly interconnected to the module; and an electrical component having a first prong for interconnection to the first receptacle of the module, a second prong for interconnection to the second receptacle, and a third prong for interconnection to the third receptacle, wherein the mounting plate is comprised of the anchor having apertures that receive mounting screws, and a protrusion that ends in a finger that is adapted to engage an outer surface of a wall, and at least one tab that is adapted to pierce the exterior wall.

It is yet another aspect of embodiments of the present invention to provide a modular electrical connector, comprising a junction box having an aperture adapted to receive a wire cable comprised of a hot wire, a neutral wire, and a ground wire, the junction box having a cavity on a lateral surface thereof; a mounting plate adapted for interconnected to a building member, the mounting plate having an anchor that is selectively received by the cavity in the junction box to interconnect the junction box to the building member; a module having: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; an indicator that illuminates when at least one of the hot wire, the neutral wire, and ground wire are properly interconnected to the module; and an electrical component having a first prong for interconnection to the first receptacle of the module, a second prong for interconnection to the second receptacle, and a third prong for interconnection to the third receptacle, wherein the first side receptacle, the second side receptacle, and the third side receptacle is adapted to receive a connector, the connector also being adapted to interface with a second module that is not interconnected to the wire cable.

It is yet another aspect of embodiments of the present invention to provide a modular electrical connector, comprising a junction box having an aperture adapted to receive a wire cable comprised of a hot wire, a neutral wire, and a ground wire, the junction box having a cavity on a lateral surface thereof; a mounting plate adapted for interconnected to a building member, the mounting plate having an anchor that is selectively received by the cavity in the junction box to interconnect the junction box to the building member; a module having: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; an indicator that illuminates when at least one of the hot wire, the neutral wire, and ground wire are properly interconnected to the module; and an electrical component having a first prong for interconnection to the first receptacle of the module, a second prong for interconnection to the second receptacle, and a third prong for interconnection to the third receptacle, wherein the module further comprises a fourth side receptacle; a fifth side receptacle; and a sixth side receptacle.

It is yet another aspect of embodiments of the present invention to provide a modular electrical connector, comprising a junction box having an aperture adapted to receive a wire cable comprised of a hot wire, a neutral wire, and a ground wire, the junction box having a cavity on a lateral surface thereof; a mounting plate adapted for interconnected to a building member, the mounting plate having an anchor that is selectively received by the cavity in the junction box to interconnect the junction box to the building member; a module having: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; an indicator that illuminates when at least one of the hot wire, the neutral wire, and ground wire are properly interconnected to the module; and an electrical component having a first prong for interconnection to the first receptacle of the module, a second prong for interconnection to the second receptacle, and a third prong for interconnection to the third receptacle, wherein the module includes a face portion that is associated with the first receptacle, the second receptacle, and the third receptacle, and further comprising a first indicia associated with the first receptacle, a second indicia associated with the second receptacle, and a third indicia associated with the third receptacle.

It is yet another aspect of embodiments of the present invention to provide a modular electrical connector, comprising a junction box having an aperture adapted to receive a wire cable comprised of a hot wire, a neutral wire, and a ground wire, the junction box having a cavity on a lateral surface thereof; a mounting plate adapted for interconnected to a building member, the mounting plate having an anchor that is selectively received by the cavity in the junction box to interconnect the junction box to the building member; a module having: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; an indicator that illuminates when at least one of the hot wire, the neutral wire, and ground wire are properly interconnected to the module; and an electrical component having a first prong for interconnection to the first receptacle of the module, a second prong for interconnection to the second receptacle, and a third prong for interconnection to the third receptacle, wherein the module includes a first connector interface that is associated with the first receptacle, a second connector interface that is associated with the second receptacle, and a third connector portion associated with the third receptacle.

It is yet another aspect of embodiments of the present invention to provide a modular electrical connector, comprising a junction box having an aperture adapted to receive a wire cable comprised of a hot wire, a neutral wire, and a ground wire, the junction box having a cavity on a lateral surface thereof; a mounting plate adapted for interconnected to a building member, the mounting plate having an anchor that is selectively received by the cavity in the junction box to interconnect the junction box to the building member; a module having: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; an indicator that illuminates when at least one of the hot wire, the neutral wire, and ground wire are properly interconnected to the module; and an electrical component having a first prong for interconnection to the first receptacle of the module, a second prong for interconnection to the second receptacle, and a third prong for interconnection to the third receptacle, wherein the module includes a first connector interface that is associated with the first receptacle, a second connector interface that is associated with the second receptacle, and a third connector portion associated with the third receptacle, wherein the first connector, the first receptacle, and the first connector interface is associated with the hot wire, the second receptacle, and the second connector interface is associated with the neutral wire, the third receptacle, and the third connector interface is associated with the ground wire.

It is yet another aspect of embodiments of the present invention to provide a modular electrical connector, comprising a junction box having an aperture adapted to receive a wire cable comprised of a hot wire, a neutral wire, and a ground wire, the junction box having a cavity on a lateral surface thereof; a mounting plate adapted for interconnected to a building member, the mounting plate having an anchor that is selectively received by the cavity in the junction box to interconnect the junction box to the building member; a module having: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; an indicator that illuminates when at least one of the hot wire, the neutral wire, and ground wire are properly interconnected to the module; and an electrical component having a first prong for interconnection to the first receptacle of the module, a second prong for interconnection to the second receptacle, and a third prong for interconnection to the third receptacle, wherein the module includes a first connector interface that is associated with the first receptacle, a second connector interface that is associated with the second receptacle, and a third connector portion associated with the third receptacle, wherein the first connector interface includes a first conductive arm associated with the first side receptacle, the second connector interface includes a second conductive arm associated with the second side receptacle, and the third connector interface includes a third conductive arm associated with the third side receptacle.

It is yet another aspect of some embodiments of the present invention to provide a modular electrical connector, comprising: a module adapted for interconnection to a junction box that accommodates a wire cable comprised of a hot wire, a neutral wire, and a ground wire, the module having: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member; and a junction component having a fourth electrical connector for interconnection to the first electrical member of the module, a fifth electrical connector for interconnection to the second electrical member of the module, and a sixth electrical connector for interconnection to the third electrical member of the module.

It is yet another aspect of some embodiments of the present invention to provide a modular electrical connector, comprising: a module adapted for interconnection to a junction box that accommodates a wire cable comprised of a hot wire, a neutral wire, and a ground wire, the module having: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member; and a junction component having a fourth electrical connector for interconnection to the first electrical member of the module, a fifth electrical connector for interconnection to the second electrical member of the module, and a sixth electrical connector for interconnection to the third electrical member of the module, wherein the junction component is an electrical outlet.

It is yet another aspect of some embodiments of the present invention to provide a modular electrical connector, comprising: a module adapted for interconnection to a junction box that accommodates a wire cable comprised of a hot wire, a neutral wire, and a ground wire, the module having: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member; and a junction component having a fourth electrical connector for interconnection to the first electrical member of the module, a fifth electrical connector for interconnection to the second electrical member of the module, and a sixth electrical connector for interconnection to the third electrical member of the module, wherein the junction component is a switch.

It is yet another aspect of some embodiments of the present invention to provide a modular electrical connector, comprising: a module adapted for interconnection to a junction box that accommodates a wire cable comprised of a hot wire, a neutral wire, and a ground wire, the module having: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member; and a junction component having a fourth electrical connector for interconnection to the first electrical member of the module, a fifth electrical connector for interconnection to the second electrical member of the module, and a sixth electrical connector for interconnection to the third electrical member of the module, wherein the first electrical member, the second electrical member, and the third electrical member are receptacles for selective receipt of the fourth electrical member, the fifth electrical member, and the third electrical member, which are prongs.

It is yet another aspect of some embodiments of the present invention to provide a modular electrical connector, comprising: a module adapted for interconnection to a junction box that accommodates a wire cable comprised of a hot wire, a neutral wire, and a ground wire, the module having: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member; and a junction component having a fourth electrical connector for interconnection to the first electrical member of the module, a fifth electrical connector for interconnection to the second electrical member of the module, and a sixth electrical connector for interconnection to the third electrical member of the module, further comprising a junction box having an aperture adapted to receive the wire cable, wherein the junction box has a cavity on a lateral surface thereof; a mounting plate adapted for interconnected to a building member, the mounting plate having an anchor that is selectively received by the cavity to interconnect the junction box to the building member; and wherein the mounting plate is comprised of the anchor having apertures that receive mounting screws, and a protrusion that ends in a finger that is adapted to engage an outer surface of an exterior wall, and at least one tab that is adapted to pierce the exterior wall.

It is yet another aspect of some embodiments of the present invention to provide a modular electrical connector, comprising: a module adapted for interconnection to a junction box that accommodates a wire cable comprised of a hot wire, a neutral wire, and a ground wire, the module having: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member; and a junction component having a fourth electrical connector for interconnection to the first electrical member of the module, a fifth electrical connector for interconnection to the second electrical member of the module, and a sixth electrical connector for interconnection to the third electrical member of the module, further comprising an indicator that illuminates when at least one of the hot wire, the neutral wire, and ground wire are properly interconnected to the module.

It is yet another aspect of some embodiments of the present invention to provide a modular electrical connector, comprising: a module adapted for interconnection to a junction box that accommodates a wire cable comprised of a hot wire, a neutral wire, and a ground wire, the module having: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member; and a junction component having a fourth electrical connector for interconnection to the first electrical member of the module, a fifth electrical connector for interconnection to the second electrical member of the module, and a sixth electrical connector for interconnection to the third electrical member of the module, wherein the first connector, the second connector, and the third connector are wire lugs.

It is yet another aspect of some embodiments of the present invention to provide a modular electrical connector, comprising: a module adapted for interconnection to a junction box that accommodates a wire cable comprised of a hot wire, a neutral wire, and a ground wire, the module having: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member; and a junction component having a fourth electrical connector for interconnection to the first electrical member of the module, a fifth electrical connector for interconnection to the second electrical member of the module, and a sixth electrical connector for interconnection to the third electrical member of the module, wherein the first side receptacle, the second side receptacle, and the third side receptacle is adapted to receive a connector, the connector also being adapted to interface with a second module that is not interconnected to a wire cable.

It is yet another aspect of some embodiments of the present invention to provide a modular electrical connector, comprising: a module adapted for interconnection to a junction box that accommodates a wire cable comprised of a hot wire, a neutral wire, and a ground wire, the module having: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member; and a junction component having a fourth electrical connector for interconnection to the first electrical member of the module, a fifth electrical connector for interconnection to the second electrical member of the module, and a sixth electrical connector for interconnection to the third electrical member of the module, wherein the module includes a face portion that is associated with the first electrical connector, the second electrical connector, and the third electrical connector, and further comprising a first indicia associated with the first electrical connector, a second indicia electrical connector with the second receptacle, and a third indicia associated with the third electrical connector.

It is yet another aspect of some embodiments of the present invention to provide a modular electrical connector, comprising: a module adapted for interconnection to a junction box that accommodates a wire cable comprised of a hot wire, a neutral wire, and a ground wire, the module having: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member; and a junction component having a fourth electrical connector for interconnection to the first electrical member of the module, a fifth electrical connector for interconnection to the second electrical member of the module, and a sixth electrical connector for interconnection to the third electrical member of the module, wherein the module further comprises a first connector interface that is associated with the first electrical connector, a second electrical connector interface that is associated with the second electrical connector, and a third electrical connector portion associated with the third electrical connector.

It is yet another aspect of some embodiments of the present invention to provide a modular electrical connector, comprising: a module adapted for interconnection to a junction box that accommodates a wire cable comprised of a hot wire, a neutral wire, and a ground wire, the module having: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member; and a junction component having a fourth electrical connector for interconnection to the first electrical member of the module, a fifth electrical connector for interconnection to the second electrical member of the module, and a sixth electrical connector for interconnection to the third electrical member of the module, wherein the module further comprises a first connector interface that is associated with the first electrical connector, a second electrical connector interface that is associated with the second electrical connector, and a third electrical connector portion associated with the third electrical connector, wherein the first electrical connector, the first electrical connector, and the first connector interface is associated with the hot wire, the second electrical connector, and the second connector interface is associated with the neutral wire, the third electrical connector, and the third connector interface is associated with the ground wire.

It is yet another aspect of some embodiments of the present invention to provide a modular electrical connector, comprising: a module adapted for interconnection to a junction box that accommodates a wire cable comprised of a hot wire, a neutral wire, and a ground wire, the module having: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member; and a junction component having a fourth electrical connector for interconnection to the first electrical member of the module, a fifth electrical connector for interconnection to the second electrical member of the module, and a sixth electrical connector for interconnection to the third electrical member of the module, wherein the module further comprises a first connector interface that is associated with the first electrical connector, a second electrical connector interface that is associated with the second electrical connector, and a third electrical connector portion associated with the third electrical connector, wherein the first electrical connector interface includes a first electrical connector arm associated with the first side receptacle, the second electrical connector interface includes a second electrical connector arm associated with the second side receptacle, and the third electrical connector interface includes a third electrical connector arm associated with the third side receptacle.

It is still yet another aspect of some embodiments of the present invention to provide a method of providing electrical energy to an outlet, comprising: providing a module interconnected to a wire cable, the module comprising: a first connector for selective receipt of the hot wire, a second connector for selective receipt of the neutral wire, a third connector for selective receipt of the ground wire, a clip for selective interconnection with a portion of the junction box, a first receptacle; a second receptacle; a third receptacle; a first side receptacle; a second side receptacle; a third side receptacle; and an indicator that illuminates when at least one of the hot wire, the neutral wire, and ground wire are properly interconnected to the module; providing an outlet having a first a first prong for interconnection to the first receptacle of the module, a second prong for interconnection to the second receptacle, and a third prong for interconnection to the third receptacle; providing electrical current to the module by way of the wire cable; and providing electrical current to the outlet via the module.

It is yet another aspect of some embodiments of the present invention to provide a module for transferring electrical energy from a wire cable to an outlet, the wire cable having a hot wire, a neutral wire, and a ground wire, comprising: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member.

It is yet another aspect of some embodiments of the present invention to provide a module for transferring electrical energy from a wire cable to an outlet, the wire cable having a hot wire, a neutral wire, and a ground wire, comprising: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member, further comprising an indicator that illuminates when at least one of the hot wire, the neutral wire, and ground wire are properly interconnected to the module.

It is yet another aspect of some embodiments of the present invention to provide a module for transferring electrical energy from a wire cable to an outlet, the wire cable having a hot wire, a neutral wire, and a ground wire, comprising: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member, wherein the first connector, the second connector, and the third connector are wire lugs.

It is yet another aspect of some embodiments of the present invention to provide a module for transferring electrical energy from a wire cable to an outlet, the wire cable having a hot wire, a neutral wire, and a ground wire, comprising: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member, wherein the first side receptacle, the second side receptacle, and the third side receptacle is adapted to receive a connector, the connector also being adapted to interface with a second module that is not interconnected to a wire cable.

It is yet another aspect of some embodiments of the present invention to provide a module for transferring electrical energy from a wire cable to an outlet, the wire cable having a hot wire, a neutral wire, and a ground wire, comprising: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member, wherein the module includes a face portion that is associated with the first electrical connector, the second electrical connector, and the third electrical connector, and further comprising a first indicia associated with the first electrical connector, a second indicia electrical connector with the second receptacle, and a third indicia associated with the third electrical connector.

It is yet another aspect of some embodiments of the present invention to provide a module for transferring electrical energy from a wire cable to an outlet, the wire cable having a hot wire, a neutral wire, and a ground wire, comprising: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member, wherein the module further comprising a first connector interface that is associated with the first electrical connector, a second electrical connector interface that is associated with the second electrical connector, and a third electrical connector portion associated with the third electrical connector.

It is yet another aspect of some embodiments of the present invention to provide a module for transferring electrical energy from a wire cable to an outlet, the wire cable having a hot wire, a neutral wire, and a ground wire, comprising: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member, wherein the module further comprising a first connector interface that is associated with the first electrical connector, a second electrical connector interface that is associated with the second electrical connector, and a third electrical connector portion associated with the third electrical connector, wherein the first electrical connector, the first electrical connector, and the first connector interface is associated with the hot wire, the second electrical connector, and the second connector interface is associated with the neutral wire, the third electrical connector, and the third connector interface is associated with the ground wire.

It is yet another aspect of some embodiments of the present invention to provide a module for transferring electrical energy from a wire cable to an outlet, the wire cable having a hot wire, a neutral wire, and a ground wire, comprising: a first connector for selective receipt of the hot wire, a second connector for selective receipt of the neutral wire, a third connector for selective receipt of the ground wire, a first electrical member; a second electrical member; a third electrical member; a first side electrical member; a second side electrical member; a third side electrical member, wherein the module further comprising a first connector interface that is associated with the first electrical connector, a second electrical connector interface that is associated with the second electrical connector, and a third electrical connector portion associated with the third electrical connector, wherein the first electrical connector interface includes a first electrical connector arm associated with the first side receptacle, the second electrical connector interface includes a second electrical connector arm associated with the second side receptacle, and the third electrical connector interface includes a third electrical connector arm associated with the third side receptacle.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
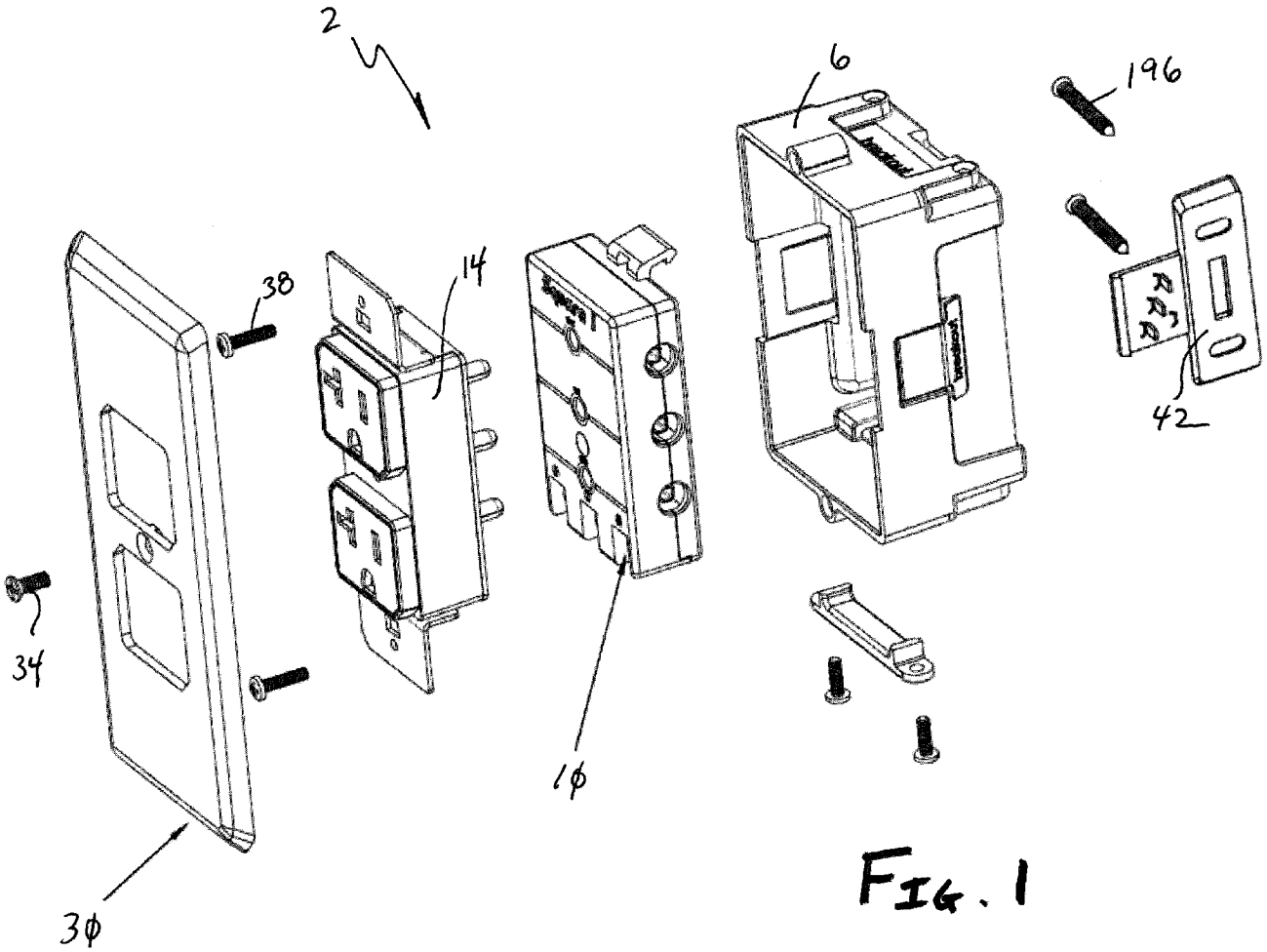
FIG. 1 is an exploded perspective view showing a modular electrical connection system of one embodiment of the present invention.

To assist in the understanding of one embodiment of the present invention the following list of components and associated numbering found in the drawings is provided herein:

Component
2 Modular electrical connection system
6 Junction box
10 Module
14 Electrical component
18 Wire cable
18H Hot wire
18G Neutral wire
18N Ground wire
22 Prong
22H Hot prong
22N Neutral prong
22G Ground prong
26 Receptacle
30 Faceplate
34 Fastener
38 Fastener
42 Mounting plate
46 Front face
50 Socket
54 Aperture
58 Rear surface
62 Frame
66 Aperture
70 Conductor
70H Hot prong conductor
70N Neutral prong conductor
70G Ground prong conductor
78H Hot contact
78N Neutral contact
78G Ground contact
82 Outer portion
86 Inner portion
90 Sleeve
94 Front face
98 Indicator
100 Indicia
102 Wire lug
106 Block
106H Hot wire conductor block
106N Neutral wire conductor block
106G Ground wire conductor block
110 Set screw
112 Clip
114 Receptacle
114H Hot side receptacle
114N Neutral side receptacle
114G Ground side receptacle
118 Lateral side
124 Outer portion
128 Inner portion
132 Slot
136 Block interface
140 Hot portion
144 Ground portion
148 Neutral portion
152 Arms
152H Hot arms
152N Neutral arms
152G Ground arms
156 Aperture
160 Top
164 Bottom
168 Breakout section
172 Side openings
180 Anchor
184 Extension
188 Finger
190 Drywall
192 Tab
196 Screw
200 Wall stud
204 Cavity
208 Slot
220 Connector
224 Male portion It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
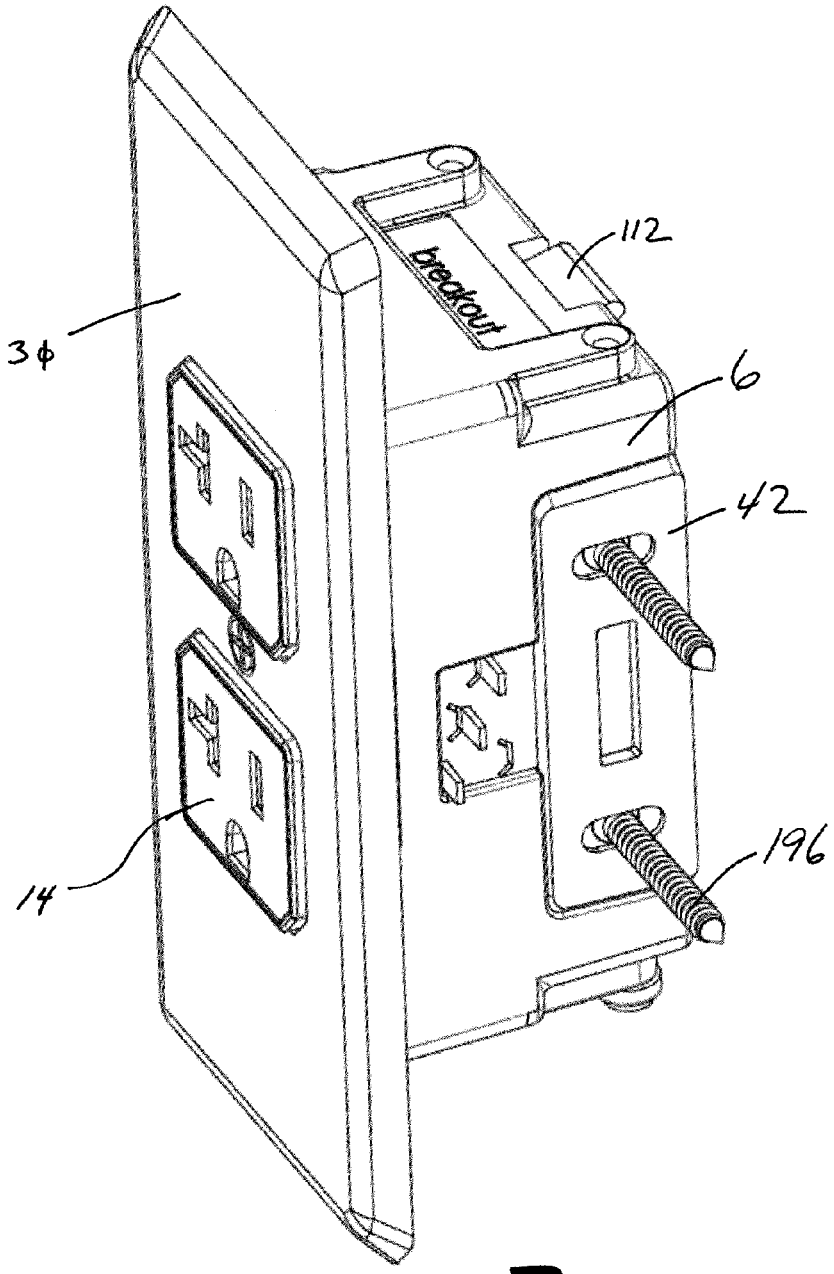
FIG. 2 is a perspective view of one embodiment of the present invention.
Figure 5:
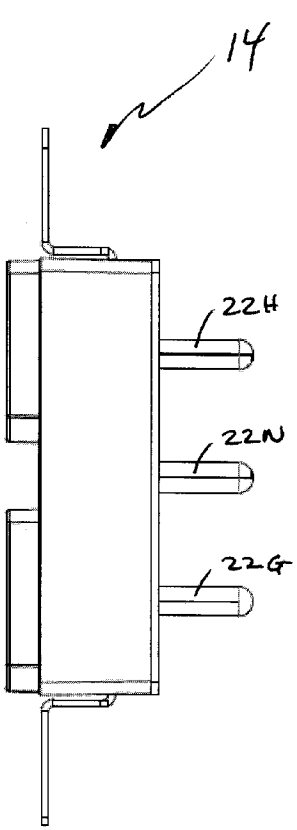
FIG. 5 is a side elevation view of the outlet shown in FIG. 3.
Figure 4:
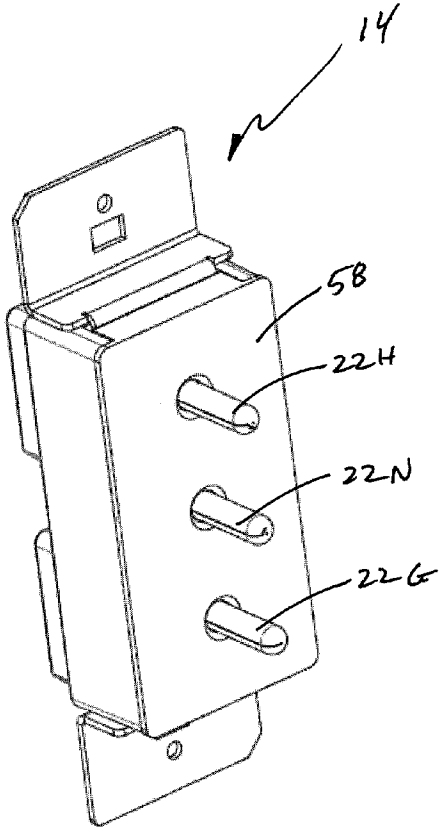
FIG. 4 is a rear perspective view of the outlet shown in FIG. 3.
Figure 3:
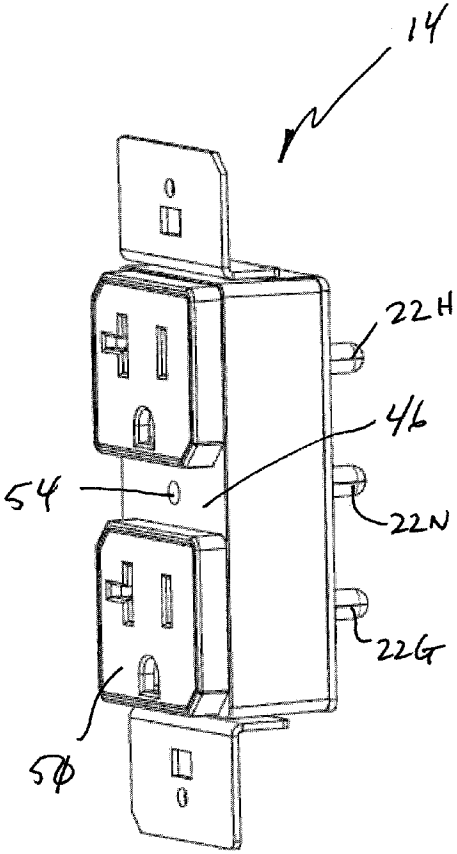
FIG. 3 is a front perspective of an outlet used in one embodiment of the present invention.

FIGS. 1 and 2 show the modular electrical connector system 2 of one embodiment of the present invention that includes a junction box 6 that receives the module 10 and an electrical component 14. Although the electrical component 14 is shown as an outlet, those of ordinary skill in the art will appreciate the module 10 of some embodiments of the present invention is able to receive other electrical components 14, such as switches. Also, as described above, the module 10 may be sized to receive multiple electrical components. Further, although a traditional 120 V outlet is shown, a larger outlet, such as a 220 V, commonly used in ovens and clothes dryers, may be accommodated.

In operation, the module 10 is interconnected to a common wire cable 18 (see FIG. 12) and then interconnected to the junction box 6. Thereafter, the electrical component 14 is selectively interconnected via prongs 22 to receptacles 28 of the module 10. The electrical component 14 is interconnected to the junction box 6 by way of a plurality of fasteners 38. Finally, a faceplate 30 is interconnected via a fastener 34 to the electrical component 14. The junction box 6 is interconnected to a mounting plate 42 interconnected to a structural member, such as a wall stud.

FIGS. 3-6 show an electrical component 14, in this case an outlet, of one embodiment of the present invention. The outlet has a front face 46 that includes a plurality of sockets 54 for interconnection to a power supply. The front face 46 also includes an aperture 54 for receipt of the fastener associated with the faceplate (not shown). The rear surface 58 of the outlet includes a plurality of outwardly-extending prongs 22 associated with a hot wire 22H, a neutral wire 22N, and a ground wire 22G of the wire cable. Prongs 22 securely fit within the module receptacles, which will be described in further detail below. Although the prongs 22 are shown in a line, those of ordinary skill in the art will appreciate prong orientation is not necessarily important, and the prongs 22 may be situated in various locations. For example it may be advantageous to further separate the hot prong 22H and the neutral prong 22N from the ground prong 22G. It may also be a advantageous to align the hot prong 22H and neutral prong 22 along a different line from that of the ground prong 22G, for example, horizontally instead of vertically, as shown. Modifying prong/receptacle alignment will reduce chances of connecting the outlet to the module incorrectly, i.e. upside-down.

Figure 6:
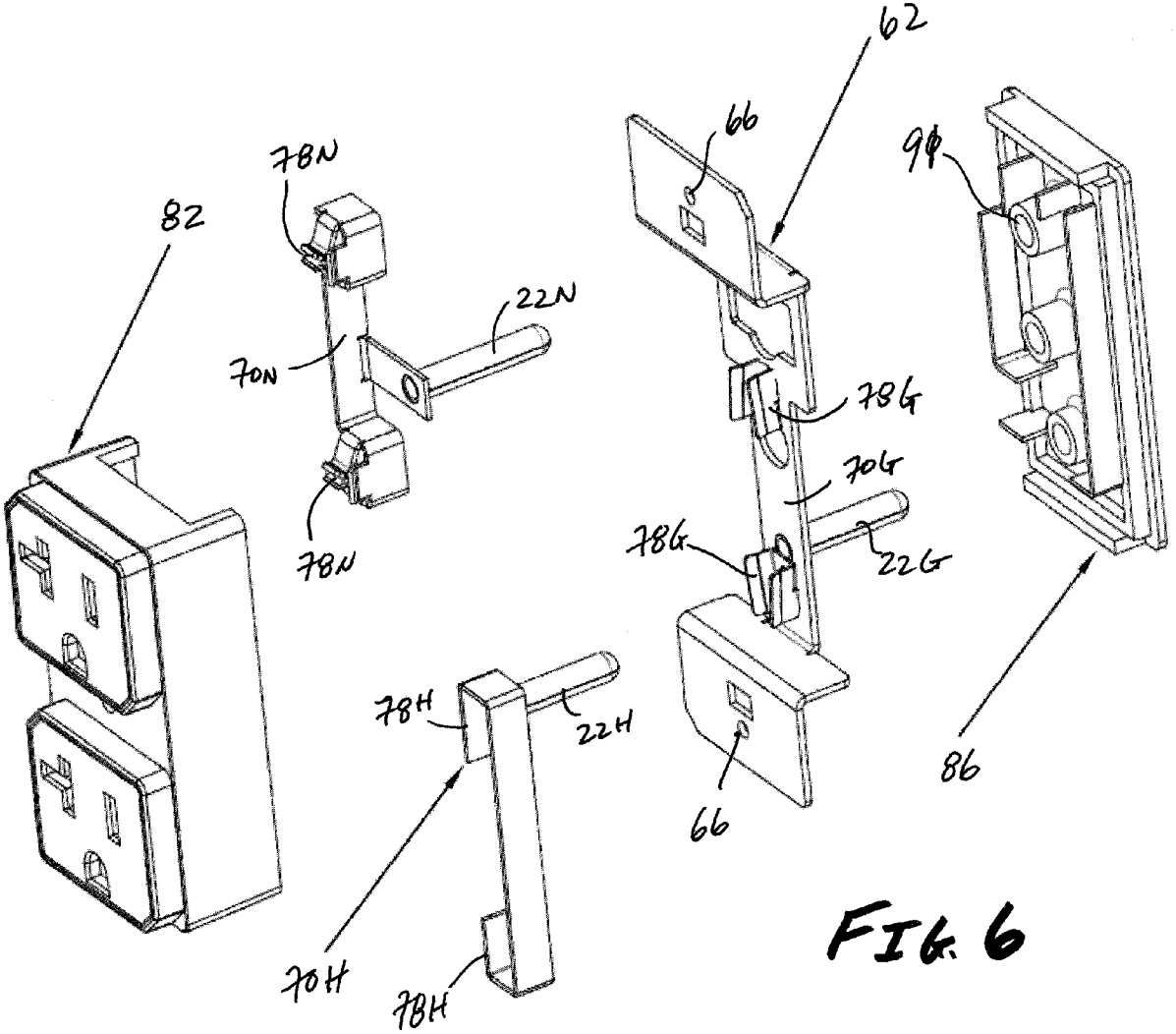
FIG. 6 is an exploded perspective view of the outlet shown in FIG. 3.
Figure 9:
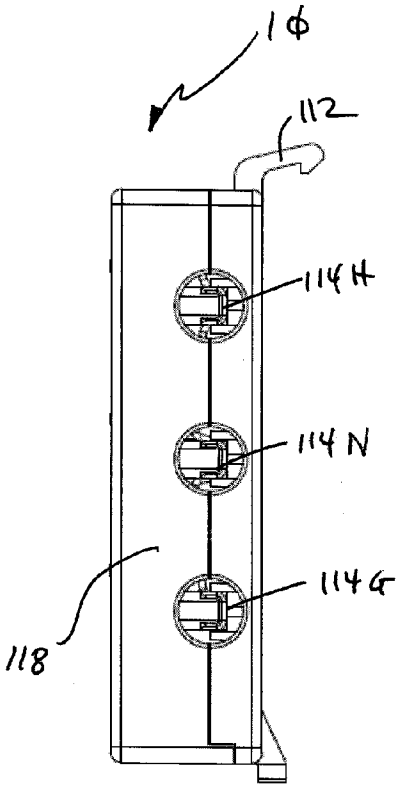
FIG. 9 is a side elevation view of the module shown in FIG. 7.
Figure 8:
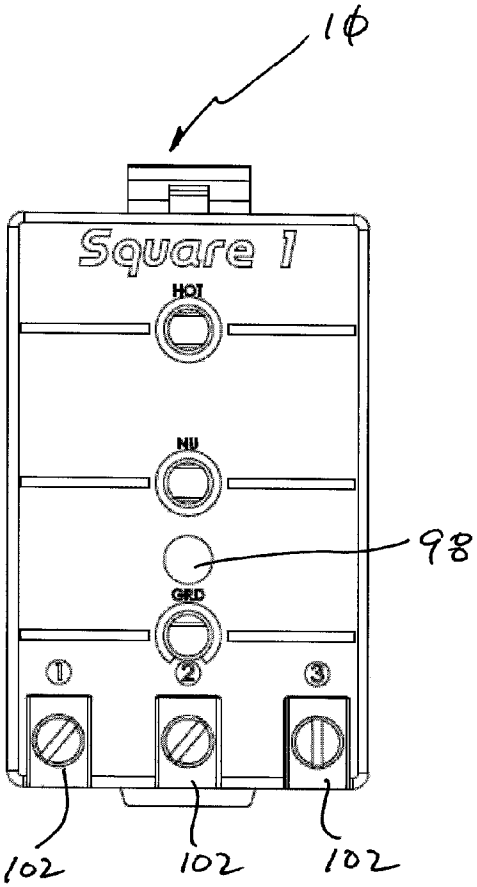
FIG. 8 is a front elevation view of the module shown in FIG. 7.
Figure 7:
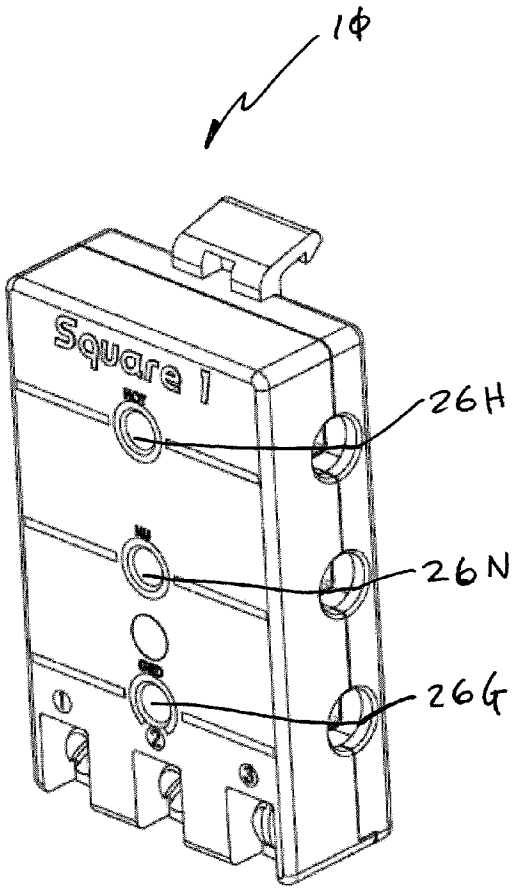
FIG. 7 is a perspective view of a module of one embodiment of the present invention.

FIG. 6 shows the internal configuration of an outlet of one embodiment of the present invention. The outlet includes a frame 62 having a plurality of apertures 66 for interconnection to the junction box (See FIG. 1.) The frame 62 also includes a conductor 70G associated with the ground prong 22G, and contacts 78G that receive a ground portion of a plug. The neutral prong 22N is also associated with a conductor 70N that has contacts 78N that receive a neutral side of a plug. A conductor 70H is associated with the hot prong 22H and has contacts 78G for a hot portion of a plug. The neutral conductor 70N, hot conductor 70H, and frame 62, are sandwiched between an outer portion 82 and an inner portion 86 of the outlet. The inner portion 86 includes a plurality of sleeves 90 that receive the prongs 22.

FIG. 7-12 show the module 10 of one embodiment of the present invention that includes a front face 94 with the plurality receptacles 26 that receive the outlet prongs described above. More specifically, a hot face receptacle 26H, a ground face receptacle 26G, and a neutral face receptacle 26N are provided. In addition, some embodiments of the present invention include an indicator 98, for example, a light, which illuminates when the module 10 is correctly interconnected to the wire cable. The front face 94 may include color codes or other indicia 100 that facilitates correct interconnection of the wires of the wire cable and prongs to the module 10. Indicia 98 on the module allows the electrician to quickly ascertain the correct locations to interconnect the wires. In one embodiment of the present invention, the wire connectors are traditional wire screws. In other embodiments, such as that shown in FIG. 11, wire lugs 102 are used that sandwich the wires from the wire cable between a block 106 and a set screw 110.

The module 10 may also include a clip 112 for interconnection to the junction box, or may be interconnected to the junction box with a screw.

In some embodiments of the present invention, a hot side receptacle 114H a ground side receptacle 114G and neutral side receptacle 114N and are provided on one or both lateral sides 118 of the module 10, which allows for multiple modules to be interconnected via a connector. In other embodiments of the present invention, one side of the module way include a plurality of prongs that interface with receptacles of an adjacent module. In still yet other embodiments of the present invention, a connector module is provided with prongs on both sides to interface with receptacles 114 of standard modules.

Figure 10:
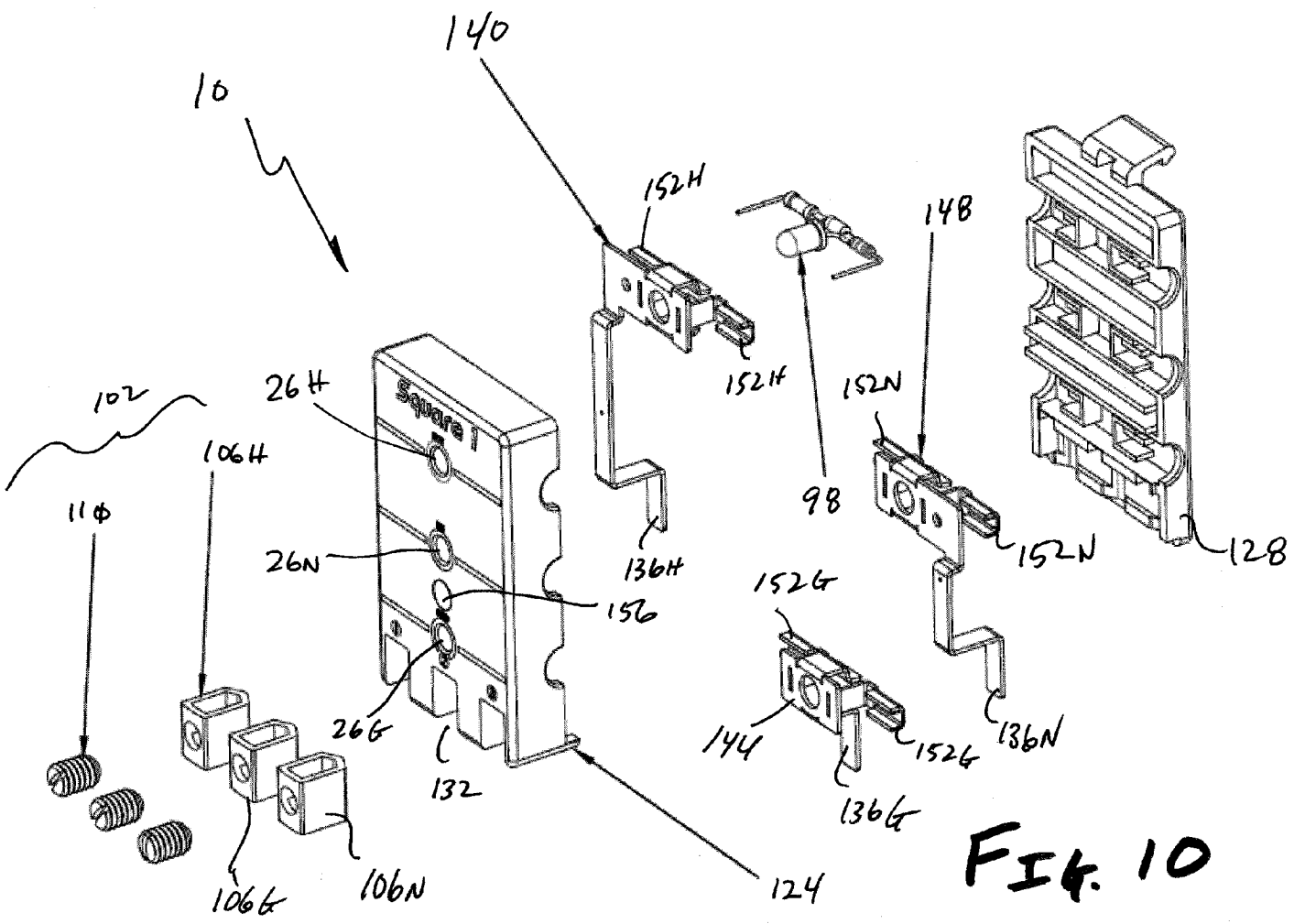
FIG. 10 is an exploded perspective view of the module shown in FIG. 7.
Figure 11:
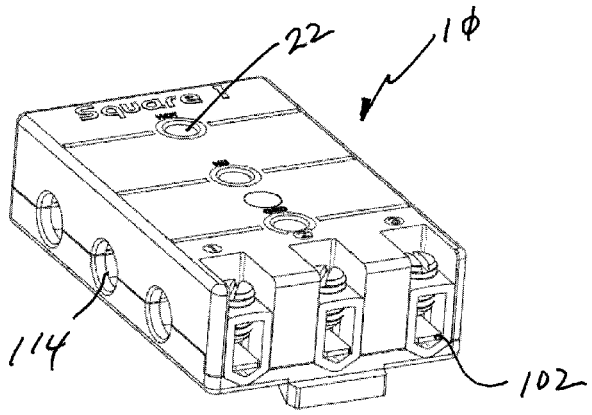
FIG. 11 is a bottom perspective view of the module shown in FIG. 7.

FIG. 10 shows an exploded view of a module of one embodiment of the present invention that includes an outer portion 124 and an inner portion 128. The outer portion 124 includes the hot receptacle 26H, the ground receptacle 26G, and the neutral receptacle 26N. The outer portion 124 also includes slots 132 that receive and secure the wire lugs 102. The block 106 interfaces with block interfaces 136 associated with a hot portion 140, a ground portion 144, and a neutral portion 148.

The hot portion 140 comprises a conductor having a block interface 136H that contacts a hot wire conductor block 106H. The hot portion 140 may include a plurality of laterally extending arms 152H associated with the side receptacles. The neutral portion 140 also includes a block interface 136N and a plurality of arms 152N extending therefrom. Finally, the ground portion 144 is a conductor having a block interface 136G and a plurality of arms 152G associated with a corresponding side receptacle.

Some embodiments of the present invention include a light 98, for example, a LED light, which allows the individual installing the module 10 to appreciate that the module has been connected to the cable wire correctly. The light 98 has leads for interconnection to the hot portion 140 and the neutral portion 148, and may emit light through an aperture 156 in the front face of the module. Some embodiments of the present invention include a switch, a button, or other means for turning off the light. In operation, one would install the wires to the module and then test the connection with a test button, for example, to ensure the connections were made correctly. In other embodiments, the light 98 emits light energy continuously it may be disabled or otherwise turned off.

Figure 12:
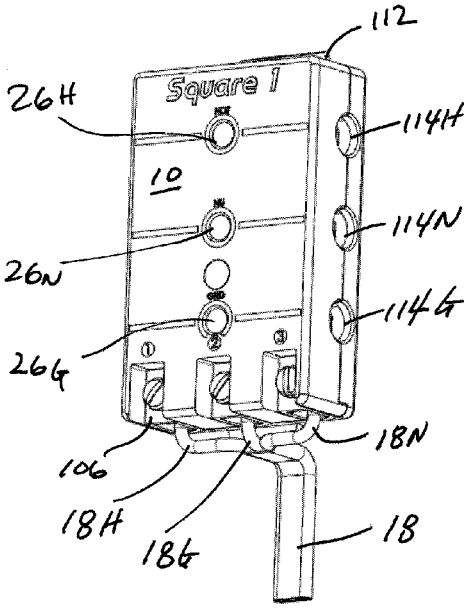
FIG. 12 is a perspective view showing the module of one embodiment of the present invention interconnected to a wire cable.

FIG. 12 shows the module 10 of one embodiment of the present invention interconnected to a wire cable 18. Here, the hot wire 18 H, ground wire 18 G, and neutral wire 18 H are connected to their respective connectors. Those of ordinary skill in the art will appreciate that the wires may be stabbed into the module 10 or connected using outlet connectors employed in the art.

Figure 13:
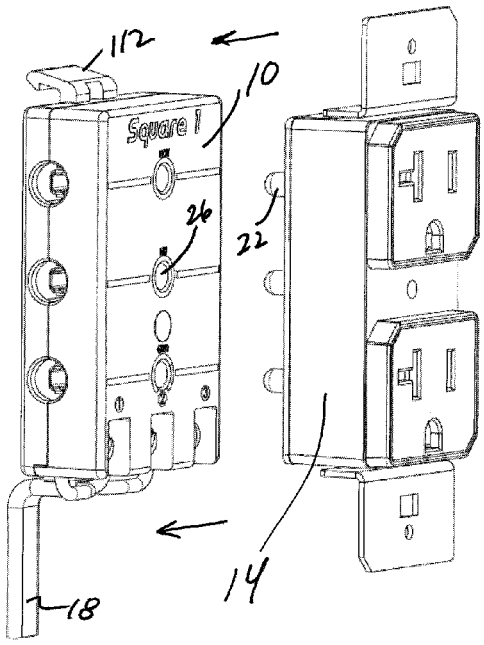
FIG. 13 is a perspective view showing an outlet before interconnection to a module of one embodiment of the present invention.
Figure 14:
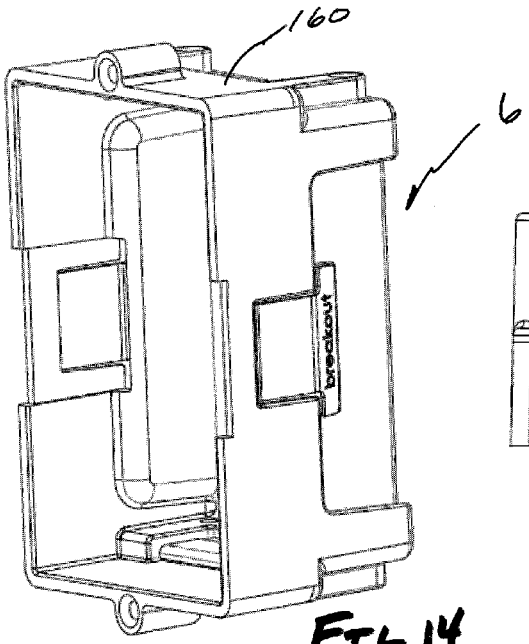
FIG. 14 is a perspective view of a junction box of one embodiment of the present invention.
Figure 17:
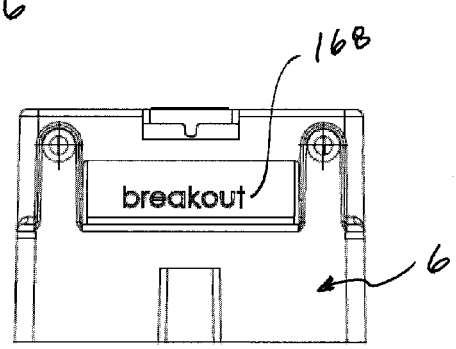
FIG. 17 is a top plan view of FIG. 14.
Figure 15:
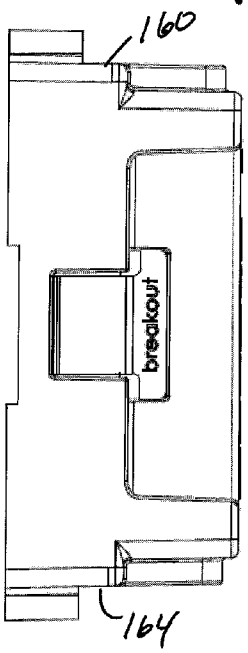
FIG. 15 is a side elevation view of FIG. 14.
Figure 16:
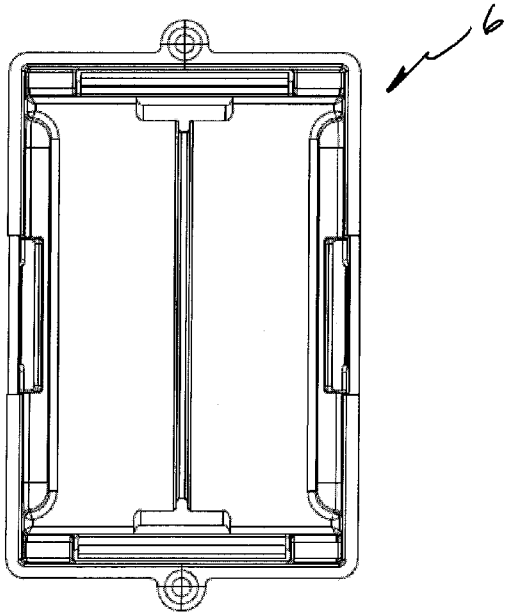
FIG. 16 is a front elevation view of FIG. 14.
Figure 18:
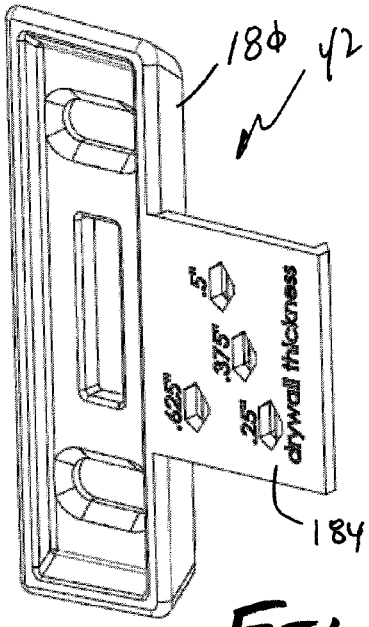
FIG. 18 is a front perspective view of a mounting plate of one embodiment of the present invention.
Figure 19:
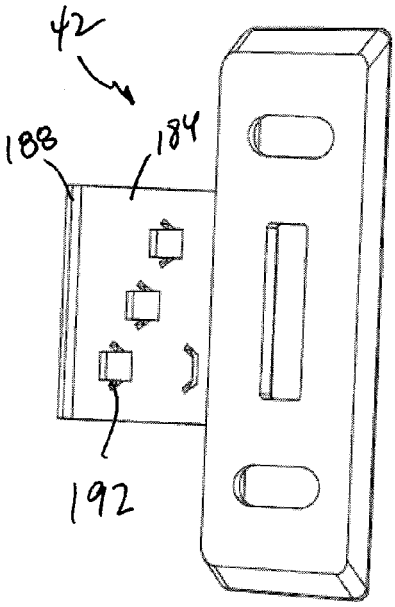
FIG. 19 is a rear perspective view of FIG. 18.
Figure 20:
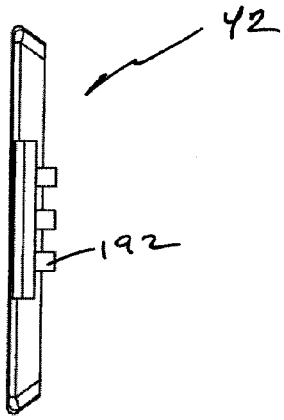
FIG. 20 is a right elevation view of FIG. 18.
Figure 21:
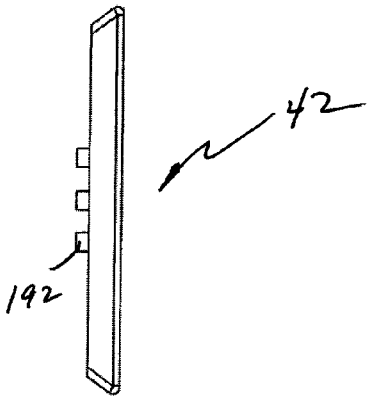
FIG. 21 is a left elevation view of FIG. 18.
Figure 22:
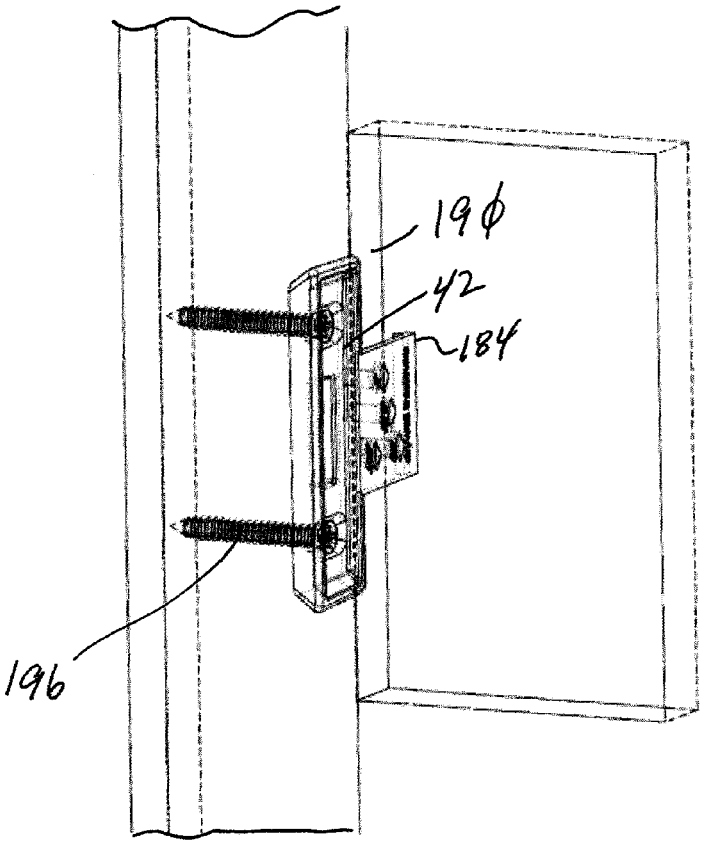
FIG. 22 is a perspective view showing the mounting plate interconnected to a wall stud.

FIG. 13 shows an outlet 14 of one embodiment of the present invention positioned next to a module 10 of one embodiment of the present invention. Here, the prongs 22 are aligned with their corresponding receptacles 26.

FIGS. 14-17 show the junction box 6 of one embodiment of the present invention. The junction box 6 is designed to be placed in any orientation as the top 116 and the bottom 164 are the same. The top 160 and the bottom 164 may include a breakout section 168 that is removed so the wire cable may be placed within the junction box 6. The junction box 6 also includes side openings 172 that receive a portion of the mounting plate, which will be described below.

FIGS. 18-22 show the mounting plate 42 of one embodiment of the present invention that includes a junction box anchor 180 and an extension 184. The extension 184 includes a finger 188 that engages an outer surface of a wall, such as the exposed portion of the drywall. As the finger 188 is engaged onto the drywall 190, a plurality of tabs 192 extending from the extension are pierced into the drywall. This temporarily secures the mounting plate to the drywall and locates the anchor 180 at an ideal location on the wall stud 200. Screws 196 are used to firmly secure the mounting plate to the wall stud 200.

Figure 23:
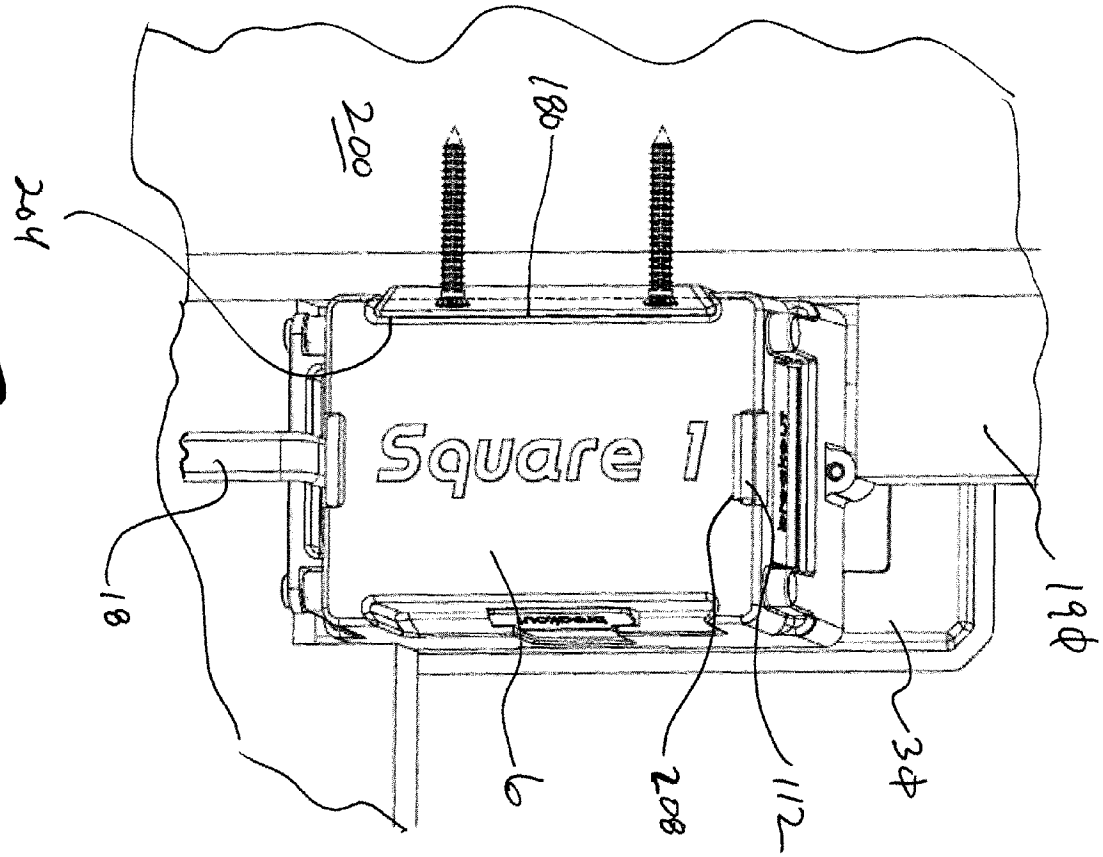
FIG. 23 is a rear view showing the junction box interconnected to a mounting plate.
Figure 24:
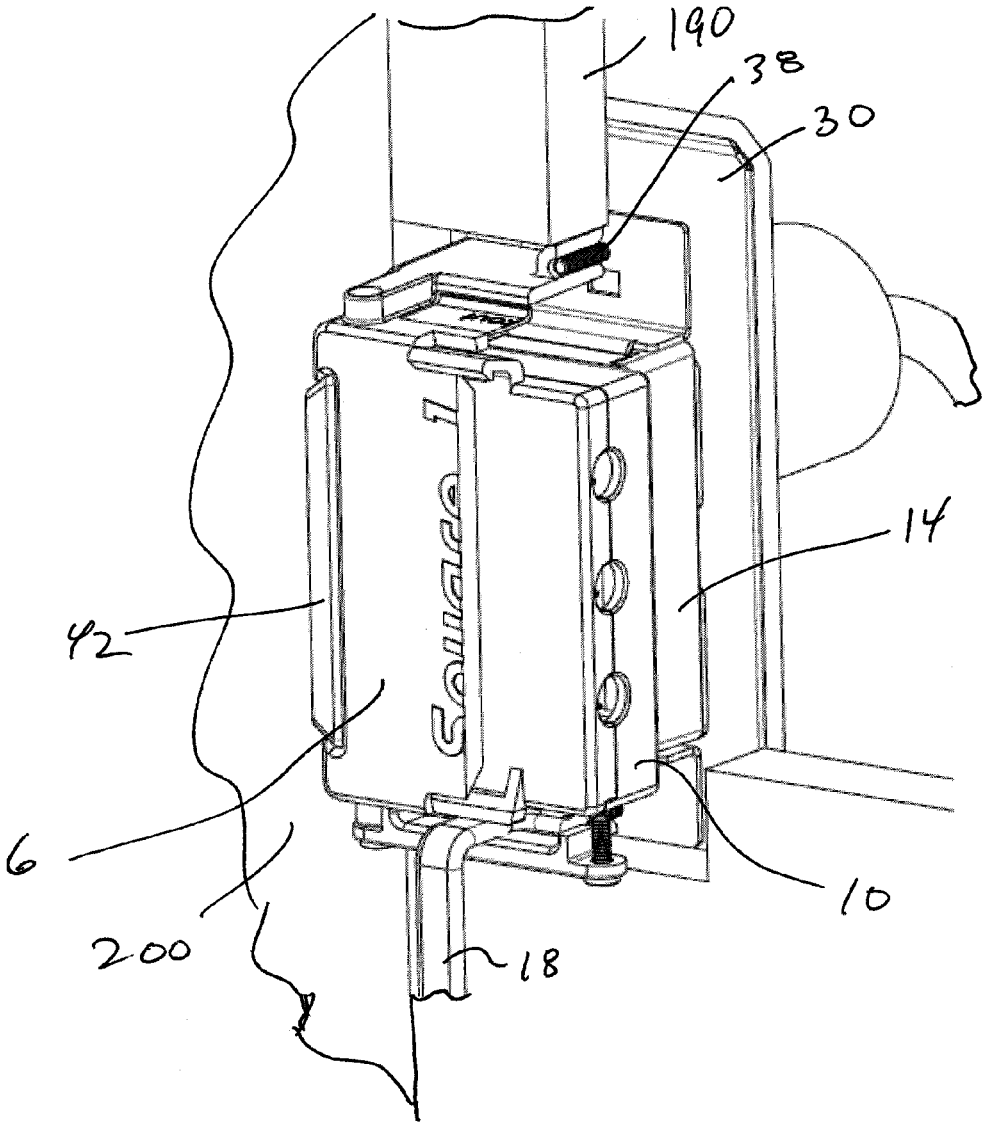
FIG. 24 is a side perspective view showing the junction box with interconnected module and outlet.
Figure 25:
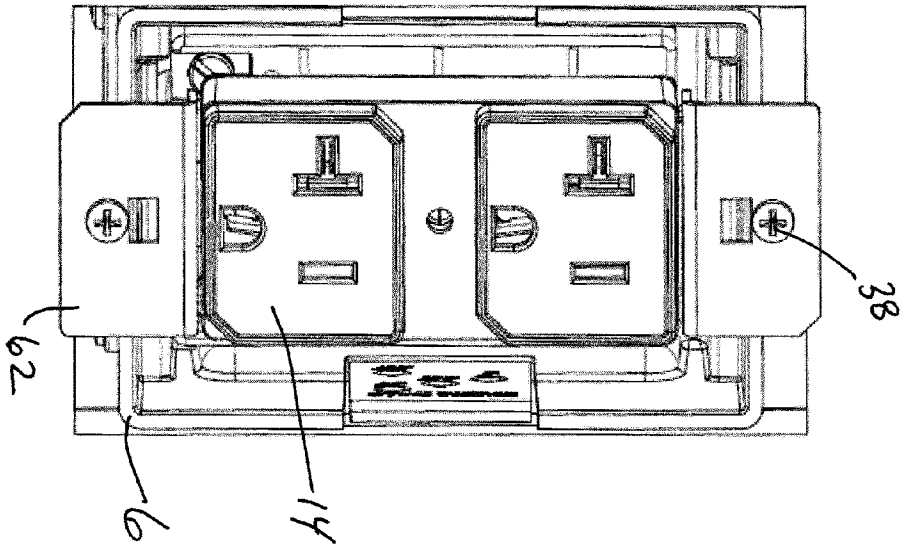
FIG. 25 is a front perspective view showing the outlet interconnected to the junction box.

As shown in FIGS. 23 and 24, after the mounting plate 42 is firmly secured to the wall stud 200, the junction box 6 is slid onto the anchor 180. That is, the junction box 6 includes a cavity 204 or slot that receives the anchor 180. The anchor 180 may include an angled outer profile that engages a corresponding cavity profile to prevent removal laterally relative to the wall stud 200.

Next, the module is interconnected to the junction box wherein the clip 112 is engaged onto a slot 208 of the junction box. Finally, the electrical component 14 is interconnected to the module by a simple plug-in connection. The electrical component 14, as shown in 25, is then screwed onto nut plates or threaded portions provided in the junction box 6.

Figure 26:
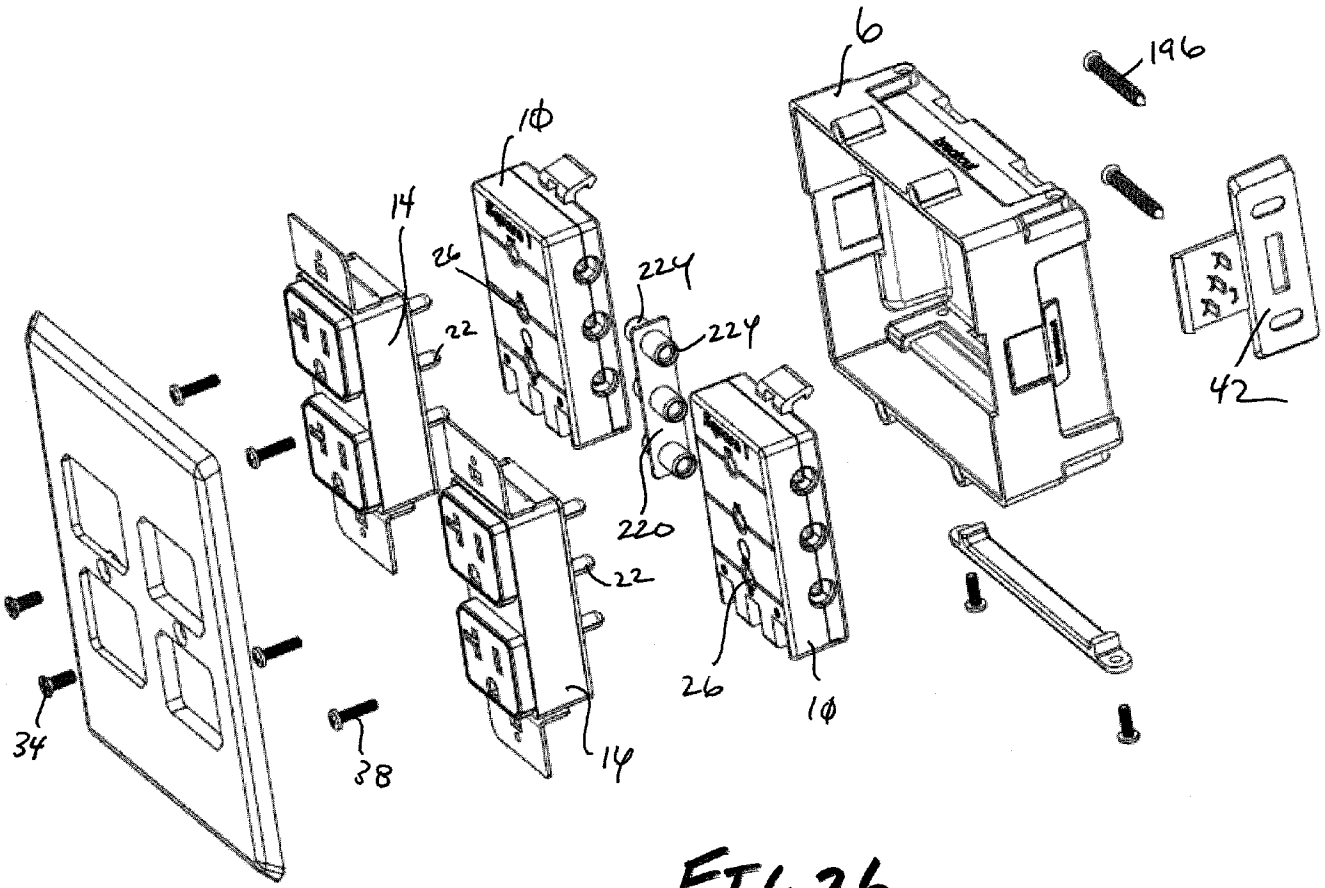
FIG. 26 is an exploded perspective view showing interconnected modules.
Figure 27:
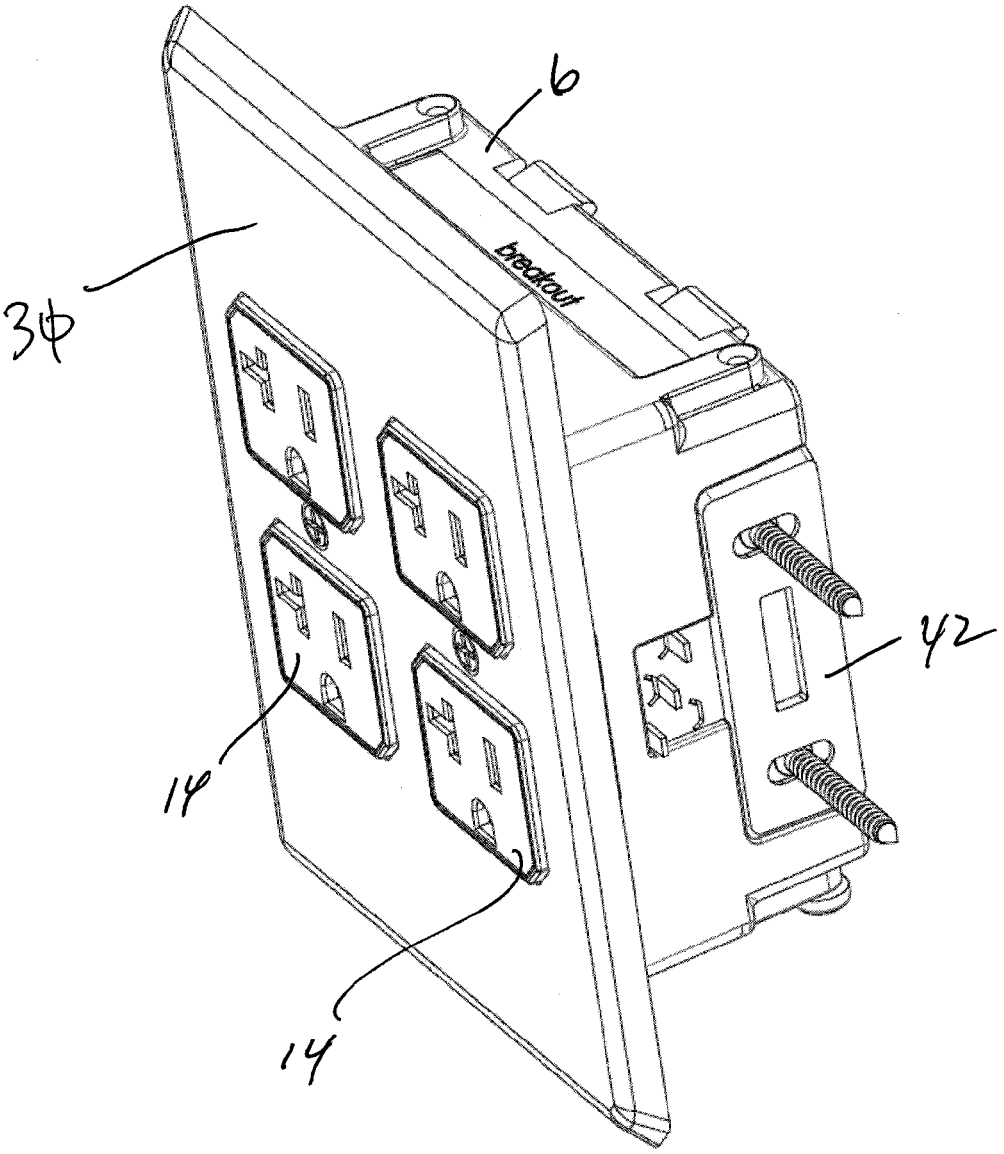
FIG. 27 is a perspective view of a larger junction box, that can accommodate multiple modules.
Figure 29:
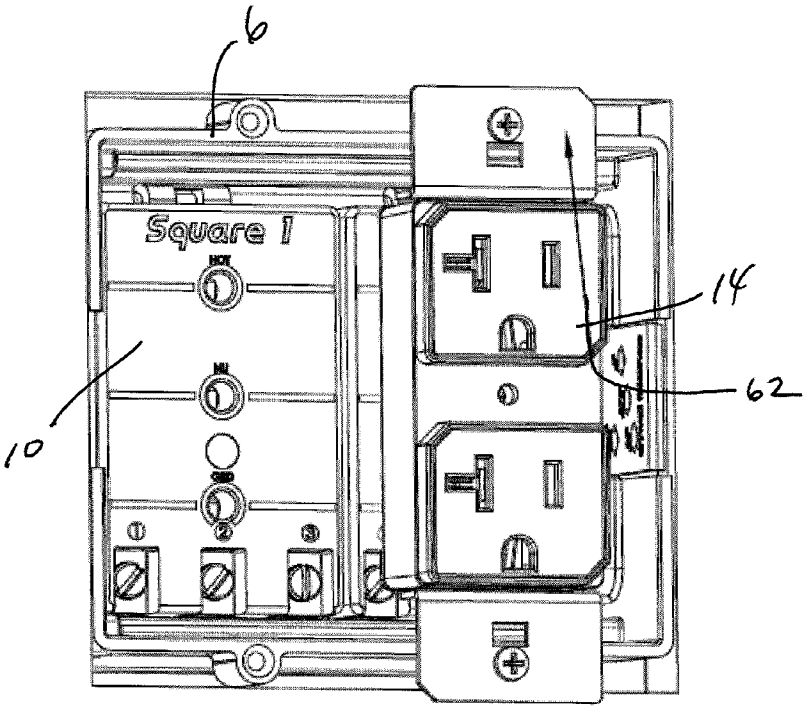
FIG. 29 is a front view showing multiple modules interconnected to a large junction box.
Figure 28:
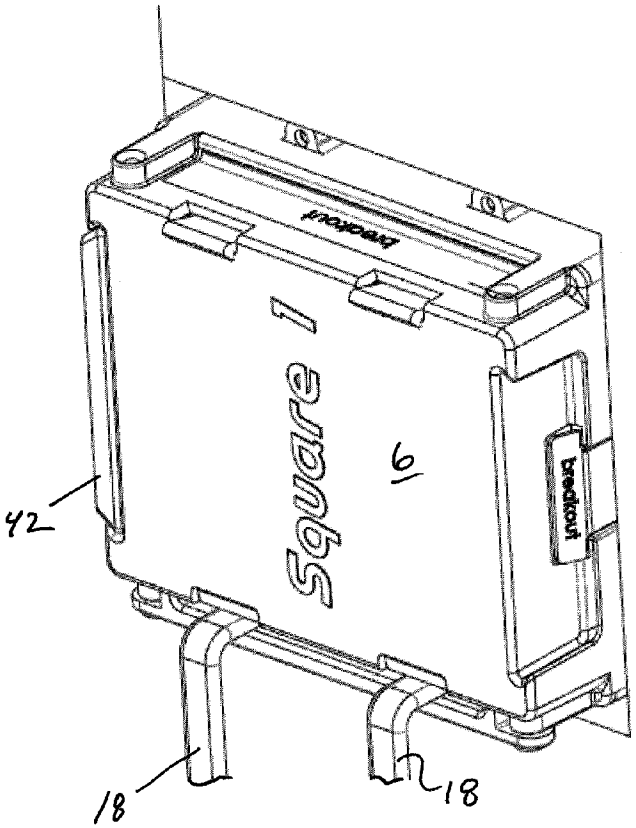
FIG. 28 is a rear perspective view showing a large junction box associated with multiple modules and interconnected to a mounting plate.

FIGS. 26-29 show another embodiment of the present invention, and illustrate the increased functionality of embodiments the present invention. More specifically, FIG. 26 shows how a connector 220 may be used to join modules 10. The connector 220 has a plurality of male conductive portions 224 received within side receptacles 114 of adjoining modules. In this fashion, power is delivered to one module and transferred through the side receptacles to another module. Thus wiring two outlets, for example, is extremely easy. That is, the longer junction box 6 only requires one wire cable, the power therefrom being used to activate additional modules. The remaining method of interconnecting this junction box to the building structure is the same as described above.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A modular electrical connector, comprising:

a junction box having an aperture adapted to receive a wire cable comprised of a hot wire, a neutral wire, and a ground wire, the junction box having a cavity on a lateral surface thereof;

a mounting plate adapted for interconnected to a building member, said mounting plate having an anchor that is selectively received by said cavity in said junction box to interconnect said junction box to said building member;

a module having:

a first connector for selective receipt of the hot wire, a second connector for selective receipt of the neutral wire, a third connector for selective receipt of the ground wire, a clip for selective interconnection with a portion of said junction box, a first receptacle;

a second receptacle;

a third receptacle;

a first side receptacle;

a second side receptacle;

a third side receptacle;

an indicator that illuminates when at least one of the hot wire, the neutral wire, and ground wire are properly interconnected to said module; and an electrical component having a first prong for interconnection to said first receptacle of said module, a second prong for interconnection to said second receptacle, and a third prong for interconnection to said third receptacle.

2. The connector of claim 1, wherein said first connector, said second connector, and said third connector are wire screws.

3. The connector of claim 1, wherein said first connector, said second connector, and said third connector are wire lugs.

4. The connector of claim 1, wherein said indicator is a LED light.

5. The connector of claim 1, wherein said first prong, said second prong, and said third prong are positioned in a plane that is parallel to a plane that corresponds with a plane that is equidistant from a left lateral surface and a right lateral surface of said outlet.

6. The connector of claim 1, wherein said mounting plate is comprised of said anchor having apertures that receive mounting screws, and a protrusion that ends in a finger that is adapted to engage an outer surface of a wall, and at least one tab that is adapted to pierce the exterior wall.

7. The connector of claim 1, wherein said first side receptacle, said second side receptacle, and said third side receptacle is adapted to receive a connector, said connector also being adapted to interface with a second module that is not interconnected to the wire cable.

8. The connector of claim 1, wherein said module further comprises a fourth side receptacle; a fifth side receptacle; and a sixth side receptacle.

9. The connector of claim 1, wherein said module includes a face portion that is associated with said first receptacle, said second receptacle, and said third receptacle, and further comprising a first indicia associated with said first receptacle, a second indicia associated with said second receptacle, and a third indicia associated with said third receptacle.

10. The connector of claim 1, wherein said module includes a first connector interface that is associated with said first receptacle, a second connector interface that is associated with said second receptacle, and a third connector interface associated with said third receptacle.

11. The connector of claim 10, wherein said first connector, said first receptacle, and said first connector interface is associated with the hot wire, said second receptacle, and said second connector interface is associated with the neutral wire, said third receptacle, and said third connector interface is associated with the ground wire.

12. The connector of claim 10, wherein said first connector interface includes a first conductive arm associated with said first side receptacle, said second connector interface includes a second conductive arm associated with said second side receptacle, and said third connector interface includes a third conductive arm associated with said third side receptacle.

13. A modular electrical connector, comprising:

a module adapted for interconnection to a junction box that accommodates a wire cable comprised of a hot wire, a neutral wire, and a ground wire, said module having:

a first connector for selective receipt of the hot wire, a second connector for selective receipt of the neutral wire, a third connector for selective receipt of the ground wire, a first electrical member;

a second electrical member;

a third electrical member;

a first side electrical member;

a second side electrical member;

a third side electrical member;

a junction component having a fourth electrical connector for interconnection to said first electrical member of said module, a fifth electrical connector for interconnection to said second electrical member of said module, and a sixth electrical connector for interconnection to said third electrical member of said module; and wherein said first side receptacle, said second side receptacle, and said third side receptacle is adapted to receive a connector, said connector also being adapted to interface with a second module that is not interconnected to a wire cable.

14. The connector of claim 13, wherein said junction component is an electrical outlet.

15. The connector of claim 13, wherein said first electrical member, said second electrical member, and said third electrical member are receptacles for selective receipt of said fourth electrical member, said fifth electrical member, and said sixth electrical member, which are cylindrical prongs.

16. The connector of claim 13, further comprising a junction box having an aperture adapted to receive the wire cable, wherein said junction box has a cavity on a lateral surface thereof;

a mounting plate adapted for interconnected to a building member, said mounting plate having an anchor that is selectively received by said cavity to interconnect said junction box to said building member; and wherein said mounting plate is comprised of said anchor having apertures that receive mounting screws, and a protrusion that ends in a finger that is adapted to engage an outer surface of an exterior wall, and at least one tab that is adapted to pierce the exterior wall.

17. The connector of claim 13, further comprising an indicator that illuminates when at least one of the hot wire, the neutral wire, and ground wire are properly interconnected to said module.

18. The connector of claim 13, wherein said module further comprises a first connector interface that is associated with said first electrical connector, a second electrical connector interface that is associated with said second electrical connector, and a third electrical connector portion associated with said third electrical connector.

19. The connector of claim 13, wherein said junction component is a switch.

20. The connector of claim 13, wherein said first connector, said second connector, and said third connector are wire lugs.

21. The connector of claim 13, wherein said module includes a face portion that is associated with said first electrical connector, said second electrical connector, and said third electrical connector, and further comprising a first indicia associated with said first electrical connector, a second indicia electrical connector with said second receptacle, and a third indicia associated with said third electrical connector.

22. The connector of claim 18, wherein said first electrical connector, said first electrical connector, and said first connector interface is associated with the hot wire, said second electrical connector, and said second connector interface is associated with the neutral wire, said third electrical connector, and said third connector interface is associated with the ground wire.

23. A method of providing electrical energy to an outlet, comprising:

providing a module interconnected to a wire cable, said module comprising:

a first connector for selective receipt of the hot wire, a second connector for selective receipt of the neutral wire, a third connector for selective receipt of the ground wire, a clip for selective interconnection with a portion of said junction box, a first receptacle;

a second receptacle;

a third receptacle;

a first side receptacle;

a second side receptacle;

a third side receptacle; and an indicator that illuminates when at least one of the hot wire, the neutral wire, and ground wire are properly interconnected to said module;

providing an outlet having a first a first prong for interconnection to said first receptacle of said module, a second prong for interconnection to said second receptacle, and a third prong for interconnection to said third receptacle;

providing electrical current to said module by way of said wire cable; and providing electrical current to said outlet via said module.

24. A module for transferring electrical energy from a wire cable to an outlet, the wire cable having a hot wire, a neutral wire, and a ground wire, comprising:

a first connector for selective receipt of the hot wire, a second connector for selective receipt of the neutral wire, a third connector for selective receipt of the ground wire, a first electrical member;

a second electrical member;

a third electrical member;

a first side electrical member;

a second side electrical member;

a third side electrical member; and wherein said module further comprising a first connector interface that is associated with said first electrical connector, a second electrical connector interface that is associated with said second electrical connector, and a third electrical connector portion associated with said third electrical connector; and wherein said first electrical connector interface includes a first electrical connector arm associated with said first side receptacle, said second electrical connector interface includes a second electrical connector arm associated with said second side receptacle, and said third electrical connector interface includes a third electrical connector arm associated with said third side receptacle.

25. The module of claim 24, further comprising an indicator that illuminates when at least one of the hot wire, the neutral wire, and ground wire are properly interconnected to said module.

26. The module of claim 24, wherein said first connector, said second connector, and said third connector are wire lugs.

27. The module of claim 24, wherein said first side receptacle, said second side receptacle, and said third side receptacle is adapted to receive a connector, said connector also being adapted to interface with a second module that is not interconnected to a wire cable.

28. The module of claim 24, wherein said module includes a face portion that is associated with said first electrical connector, said second electrical connector, and said third electrical connector, and further comprising a first indicia associated with said first electrical connector, a second indicia electrical connector with said second receptacle, and a third indicia associated with said third electrical connector.

29. The module of claim 24, wherein said first electrical connector, said first electrical connector, and said first connector interface is associated with the hot wire, said second electrical connector, and said second connector interface is associated with the neutral wire, said third electrical connector, and said third connector interface is associated with the ground wire.

30. A modular electrical connector, comprising:

a module adapted for interconnection to a junction box that accommodates a wire cable comprised of a hot wire, a neutral wire, and a ground wire, said module having:

a first connector for selective receipt of the hot wire, a second connector for selective receipt of the neutral wire, a third connector for selective receipt of the ground wire, a first electrical member;

a second electrical member;

a third electrical member;

a first side electrical member;

a second side electrical member;

a third side electrical member;

a junction component having a fourth electrical connector for interconnection to said first electrical member of said module, a fifth electrical connector for interconnection to said second electrical member of said module, and a sixth electrical connector for interconnection to said third electrical member of said module;

wherein said first side receptacle, said second side receptacle, and said third side receptacle is adapted to receive a connector, said connector also being adapted to interface with a second module that is not interconnected to a wire cable; and wherein said first electrical connector includes a first electrical connector arm associated with said first side receptacle, said second electrical connector includes a second electrical connector arm associated with said second side receptacle, and said third electrical connector includes a third electrical connector arm associated with said third side receptacle.

* * * * *